US011255334B2

(12) United States Patent
Ishii et al.

(10) Patent No.: US 11,255,334 B2
(45) Date of Patent: Feb. 22, 2022

(54) CENTRIFUGAL BLOWER

(71) Applicant: DENSO CORPORATION, Kariya (JP)

(72) Inventors: Fumiya Ishii, Kariya (JP); Shuzo Oda, Kariya (JP)

(73) Assignee: DENSO CORPORATION, Kariya (JP)

( * ) Notice: Subject to any disclaimer, the term of this patent is extended or adjusted under 35 U.S.C. 154(b) by 124 days.

(21) Appl. No.: 16/542,185

(22) Filed: Aug. 15, 2019

(65) Prior Publication Data

US 2019/0368498 A1 Dec. 5, 2019

Related U.S. Application Data

(63) Continuation of application No. PCT/JP2018/004463, filed on Feb. 8, 2018.

(30) Foreign Application Priority Data

Feb. 20, 2017 (JP) ..... JP2017-029236
Dec. 15, 2017 (JP) ..... JP2017-240912

(51) Int. Cl.
*F04D 17/16* (2006.01)
*F04D 29/28* (2006.01)
(Continued)

(52) U.S. Cl.
CPC ..... *F04D 17/16* (2013.01); *F04D 29/281* (2013.01); *F04D 29/384* (2013.01);
(Continued)

(58) Field of Classification Search
CPC .... F04D 29/281; F04D 29/663; F04D 29/681; F04D 29/30; F04D 29/2216; F04D 29/2238; F04D 29/2272; F05D 2240/303
See application file for complete search history.

(56) References Cited

U.S. PATENT DOCUMENTS 5,692,262 A * 12/1997 Haupt ..... A47L 5/14 15/339
8,235,668 B2 * 8/2012 Shirahama ..... F04D 29/283 416/187
(Continued)

FOREIGN PATENT DOCUMENTS

JP H01174598 U 12/1989
JP H04171299 A 6/1992
(Continued)

OTHER PUBLICATIONS

Iwata Toru, Machine Translation of JP2001153094A, Jun. 5, 2001 (Year: 2001).*
(Continued)

*Primary Examiner* — Courtney D Heinle
*Assistant Examiner* — Michael K. Reitz
(74) *Attorney, Agent, or Firm* — Harness, Dickey & Pierce, P.L.C.

(57) ABSTRACT

A centrifugal blower includes a turbofan. The turbofan includes blades, a shroud ring, and a main panel. Each blade includes a leading edge that is located inward of the shroud ring in a radial direction of the turbofan, and a trailing edge that is located on an outer side in the radial direction of the turbofan. The leading edge includes a second side region located on the second side in the rotation axis direction, and a first side region located on the first side of the second side region in the rotation axis direction. The first side region is located on the first side in the rotation axis direction compared with the trailing edge. Stepped portions are formed only in a part of the leading edge, the stepped portions being formed in the first side region or in the first side region and the second side region.

1 Claim, 15 Drawing Sheets

(51) Int. Cl.

| | |
|---|---|
| ***F04D 29/38*** | (2006.01) |
| ***F04D 29/30*** | (2006.01) |
| ***F04D 19/00*** | (2006.01) |
| ***F04D 25/06*** | (2006.01) |
| ***F04D 29/66*** | (2006.01) |

(52) U.S. Cl.
CPC ..... *F04D 19/002* (2013.01); *F04D 25/06* (2013.01); *F04D 29/30* (2013.01); *F04D 29/661* (2013.01); *F05D 2240/303* (2013.01)

(56) References Cited

U.S. PATENT DOCUMENTS

| | | | | |
|---|---|---|---|---|
| 8,870,541 | B2 * | 10/2014 | Imahigashi | F04D 29/30 416/187 |
| 9,829,004 | B2 * | 11/2017 | Ikeda | F04D 25/088 |
| 2011/0023526 | A1 * | 2/2011 | Ohyama | F04D 29/30 62/426 |
| 2015/0226227 | A1 | 8/2015 | Ikeda et al. | |
| 2017/0275997 | A1 * | 9/2017 | Nakashima | F04D 29/666 |
| 2018/0328376 | A1 | 11/2018 | Ishii et al. | |

FOREIGN PATENT DOCUMENTS

| | | | | | |
|---|---|---|---|---|---|
| JP | 2001153094 | A | * | 6/2001 | F04D 29/30 |
| JP | 2007205268 | A | * | 8/2007 | F04D 29/30 |
| JP | 5955402 | B2 | | 7/2016 | |
| WO | WO-2014061094 | A1 | | 4/2014 | |
| WO | WO-2017090347 | A1 | | 6/2017 | |

OTHER PUBLICATIONS

Terakawa, Machine Translation of JP2007205268A, Aug. 16, 2007 (Year: 2007).*

* cited by examiner

CENTRIFUGAL BLOWER

CROSS REFERENCE TO RELATED APPLICATION

The present application is a continuation application of International Patent Application No. PCT/JP2018/004463 filed on Feb. 8, 2018, which designated the U.S. and claims the benefit of priority from Japanese Patent Application No. 2017-29236 filed on Feb. 20, 2017, and Japanese Patent Application No. 2017-240912 filed on Dec. 15, 2017. The entire disclosures of all of the above applications are incorporated herein by reference.

TECHNICAL FIELD

The present disclosure relates to a centrifugal blower including a turbofan.

BACKGROUND

A turbofan provided in a blower may have blades, a shroud ring, and a main panel. This type of centrifugal blower includes a protruded and recessed portion throughout a leading edge of each blade.

SUMMARY

According to an aspect of the present disclosure, a centrifugal blower that blows air includes a rotation shaft, and a turbofan fixed to the rotation shaft and configured to rotate with the rotation shaft. The turbofan includes a plurality of blades disposed around the rotation shaft, a shroud ring having an annular shape to define an intake hole through which the air is taken in, the shroud ring being connected to a first side blade end of each blade of the plurality of blades on a first side in a rotation axis direction, and a main panel connected to a second side blade end of the each blade on a second side in the rotation axis direction, the main panel being fixed to the rotation shaft. The each blade includes a leading edge that is an edge located inward of the shroud ring in a radial direction of the turbofan, and a trailing edge that is an edge located on an outer side in the radial direction of the turbofan. The leading edge includes a second side region located on the second side in the rotation axis direction, and a first side region located on the first side of the second side region in the rotation axis direction. The first side region is located on the first side in the rotation axis direction compared with the trailing edge. Stepped portions are formed only in a part of the leading edge, the stepped portions being formed in the first side region or in the first side region and the second side region.

BRIEF DESCRIPTION OF THE DRAWINGS

FIG. 7 is an enlarged cross-sectional view of the area around the rotor housing portion of the blower according to at least one embodiment, as a cross-sectional view taken at a position different from the position at which FIG. 6 is taken.

EMBODIMENTS

Firstly, a comparative example of the present disclosure will be described below. In a turbofan having blades, a shroud ring, and a main panel, if stepped portions are provided throughout a leading edge of one blade, an amount of work performed by the one blade for air may considerably decrease. Accordingly, a rotation speed of the turbofan may need to increase to obtain a predetermined air volume. Noise may increase as the rotation speed increases.

Moreover, an airflow separates from a negative pressure surface of the blade near the shroud ring during rotation of the turbofan. This separation may generate noise.

Embodiments according to the present disclosure are hereinafter described with reference to the drawings. In the respective embodiments described herein, identical or equivalent parts are given identical reference numbers.

First Embodiment

Figure 1:
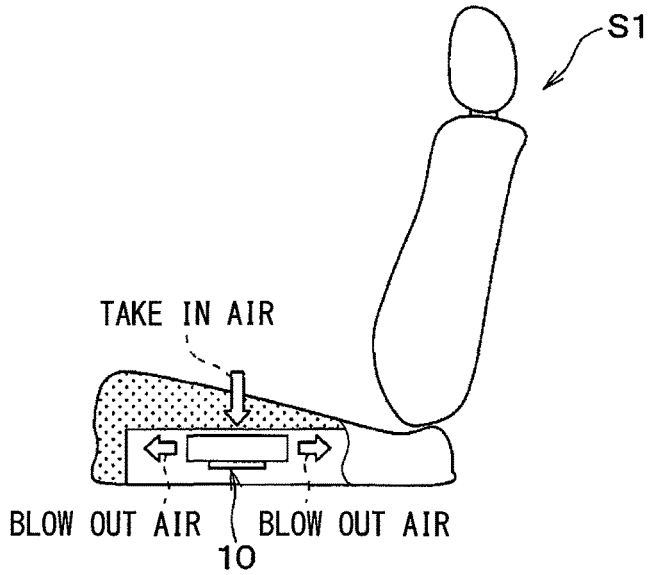
FIG. 1 is a view showing a side surface and a partial cross section of a vehicle seat which includes a blower according to at least one embodiment of the present disclosure.

As shown in FIG. 1, a blower 10 according to the present embodiment is used as a seat air conditioner for a vehicle.

The blower 10 is housed inside a seat S1 on which an occupant sits. The blower 10 takes in air from an occupant side surface of the seat S1. The blower 10 blows out air inside the seat S1. The air blown from the blower 10 is released from the seat S1 through a region other than the occupant side surface.

Figure 2:
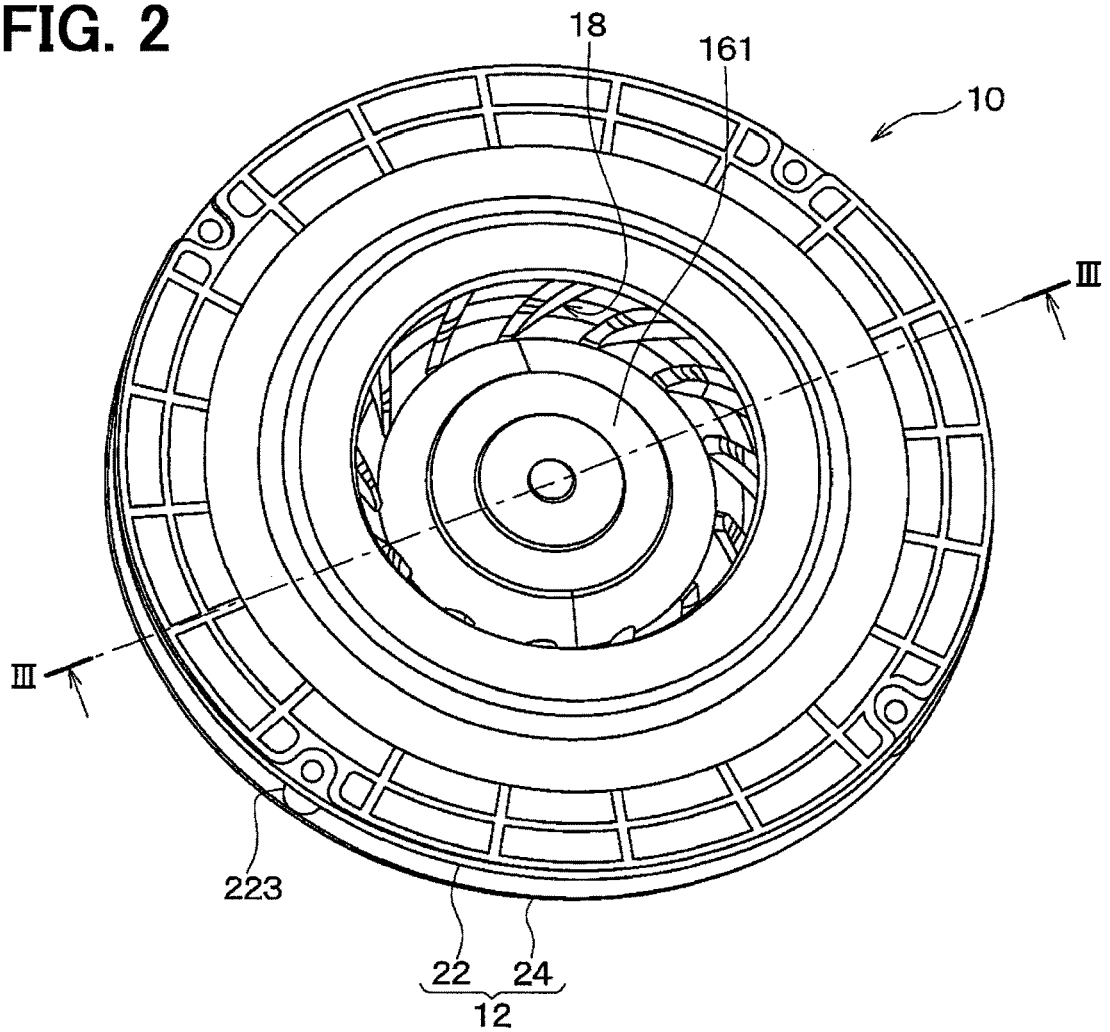
FIG. 2 is a perspective view of a blower according to at least one embodiment.
Figure 3:
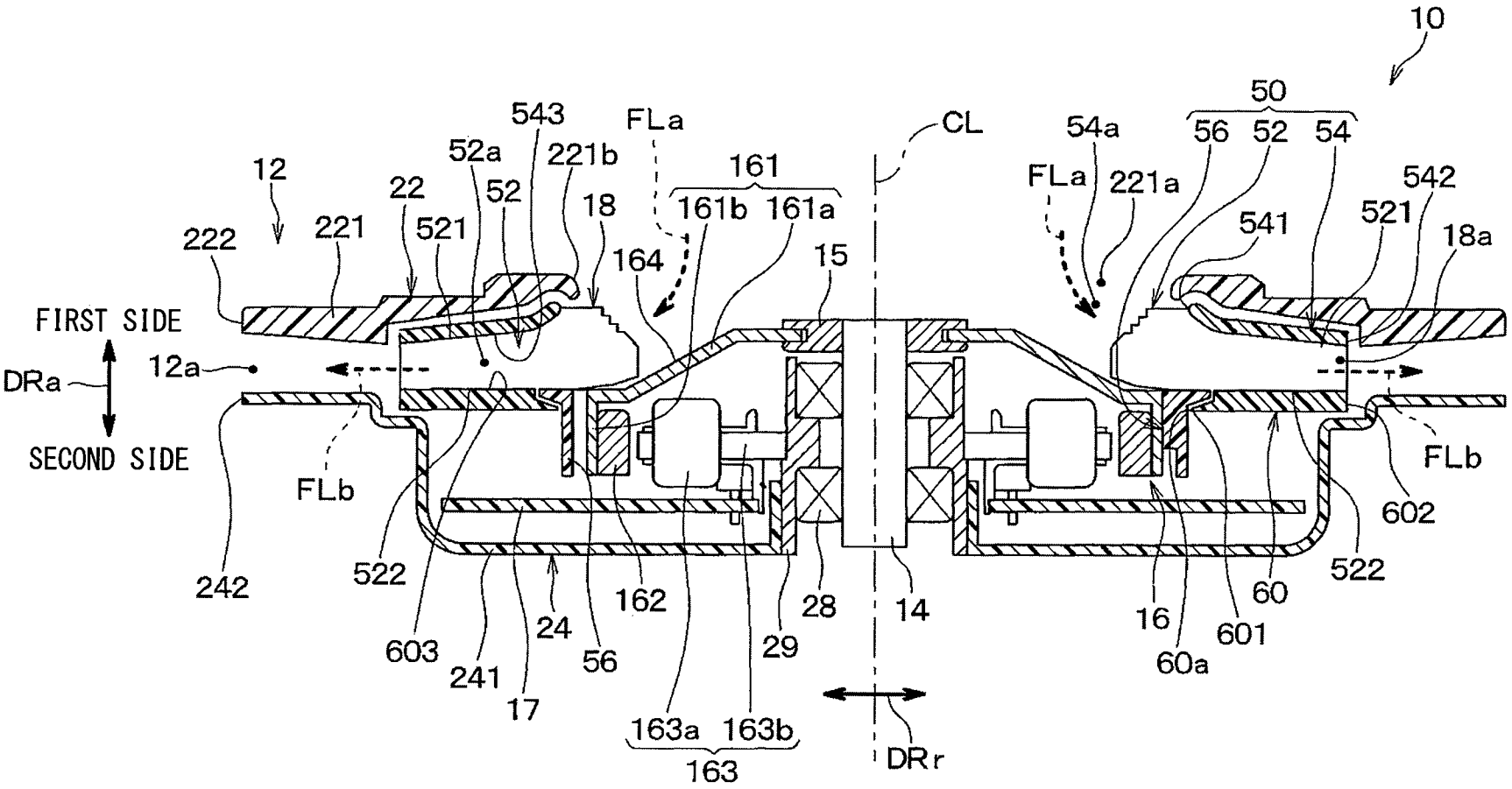
FIG. 3 is a cross-sectional view taken along a line III-III in FIG. 2.

As shown in FIGS. 2 and 3, the blower 10 is a centrifugal blower. More specifically, the blower 10 is a turbo type blower. As shown in FIG. 3, the blower 10 includes a casing 12, a rotation shaft 14, a rotation shaft housing 15, an electric motor 16, an electronic substrate 17, a turbofan 18, a bearing 28, a bearing housing 29, and others. An arrow DRa in FIG. 3 indicates a fan axial center direction. A fan axial center CL coincides with an axial center of the rotation shaft 14. The fan axial center direction is also referred to as a rotation axis direction. An arrow DRr in FIG. 3 indicates a fan radial direction.

The casing 12 is a housing of the blower 10. The casing 12 protects the electric motor 16, the electronic substrate 17, and the turbofan 18 from external dust and dirt outside the blower 10. The casing 12 is therefore configured to house the electric motor 16, the electronic substrate 17, and the turbofan 18. The casing 12 further includes a first case member 22 and a second case member 24.

The first case member 22 is made of resin. The first case member 22 has a diameter larger than a diameter of the turbofan 18, and has a substantially disk shape. The first case member 22 has a first cover portion 221 and a first circumferential edge 222.

The first cover portion 221 is disposed on a first side in the fan axial center direction DRa with respect to the turbofan 18. An air intake port 221*a* formed on the inner circumferential side of the first cover portion 221 penetrates the first cover portion 221 in the fan axial center direction DRa. Air is taken into the turbofan 18 through the air intake port 221*a*. The first cover portion 221 further has a bell mouth portion 221*b* which constitutes a circumferential edge of the air intake port 221*a*. The bell mouth portion 221*b* smoothly guides air into the air intake port 221*a* when the air flows from the outside of the blower 10 into the air intake port 221*a*. The first circumferential edge 222 constitutes a circumferential edge of the first case member 22 around the fan axial center CL.

As shown in FIG. 2, the first case member 22 has a plurality of columns 223. The plurality of columns 223 are disposed on an outer side in the fan radial direction DRr with respect to the turbofan 18. The first case member 22 and the second case member 24 are coupled to each other in a state that each leading end of the columns 223 is abutted against the second case member 24.

The second case member 24 has a substantially disk shape having a diameter substantially equal to a diameter of the first case member 22. The second case member 24 is made of resin. The second case member 24 may be made of metal such as iron or stainless steel.

As shown in FIG. 3, the second case member 24 also functions as a motor housing which covers the electric motor 16 and the electronic substrate 17. The second case member 24 has a second cover portion 241 and a second circumferential edge 242.

The second cover portion 241 is disposed on a second side in the fan axial center direction DRa with respect to the turbofan 18 and the electric motor 16. The second cover portion 241 covers the second side of the turbofan 18 and the electric motor 16. The second circumferential edge 242 constitutes a circumferential edge of the second case member 24 around the fan axial center CL.

An air blowout port 12*a* formed between the first circumferential edge 222 and the second circumferential edge 242 is a port through which air blown from the turbofan 18 is blown out.

Each of the rotation shaft 14 and the rotation shaft housing 15 is made of metal such as iron, stainless steel, and brass. The rotation shaft 14 is constituted by a cylindrical rod member. The rotation shaft 14 is pressed into each of the rotation shaft housing 15 and an inner ring of the bearing 28 for fixation. An outer ring of the bearing 28 is pressed into the bearing housing 29 for fixation. The bearing housing 29 is fixed to the second cover portion 241. For example, the bearing housing 29 is made of metal such as aluminum alloy, brass, iron, and stainless steel.

Accordingly, the rotation shaft 14 and the rotation shaft housing 15 are supported relative to the second cover portion 241 with the bearing 28 interposed therebetween. More specifically, the rotation shaft 14 and the rotation shaft housing 15 are rotatable relative to the second cover portion 241 around the fan axial center CL.

The electric motor 16 is an outer rotor type brushless DC motor. The electric motor 16 includes a motor rotor 161, a rotor magnet 162, and a motor stator 163.

The motor rotor 161 is constituted by a metal plate such as a steel plate. The motor rotor 161 is formed by pressing a metal plate. The motor rotor 161 has a rotor body portion 161*a* and a rotor outer circumferential portion 161*b*.

The rotor body portion 161*a* has a disk shape having an opening at a center of the rotor body portion 161*a*. The rotor body portion 161*a* has such a shape which extends toward the second side in the fan axial center direction DRa with nearness to the outer side from the inner side in the fan radial direction DRr. An open end of the rotor body portion 161*a* is crimped to the rotation shaft housing 15. In this manner, the motor rotor 161 and the rotation shaft housing 15 are fixed to each other. Accordingly, the motor rotor 161 is fixed to the rotation shaft 14 with the rotation shaft housing 15 interposed therebetween.

A surface of the rotor body portion 161*a* on the first side in the fan axial center direction DRa constitutes an airflow guide surface 164 for guiding an airflow. The airflow guide surface 164 guides an airflow, which has been taken through the air intake port 221*a* and faces in the fan axial center direction DRa, toward the outer side in the fan radial direction DRr.

The rotor outer circumferential portion 161*b* is located at an outer circumferential end of the rotor body portion 161*a* in the fan radial direction DRr. The rotor outer circumferential portion 161*b* cylindrically extends from the outer circumferential end of the rotor body portion 161*a* toward the second side in the fan axial center direction DRa. The rotor outer circumferential portion 161*b* is press-fitted to the inner circumferential side of a rotor housing portion 56 of the turbofan 18 described below. In this manner, the turbofan 18 and the motor rotor 161 are fixed to each other.

In the manner described above, the turbofan 18 and the motor rotor 161 are fixed, with the rotation shaft housing 15 interposed therebetween, to the rotation shaft 14 rotatable around the fan axial center CL. Accordingly, the turbofan 18 and the motor rotor 161 are rotatably supported around the fan axial center CL relative to the casing 12 which is a non-rotational member of the blower 10.

The rotor magnet 162 is a permanent magnet, and is constituted by a rubber magnet containing ferrite, neodymium, and the like, for example. The rotor magnet 162 is fixed to an inner circumferential surface of the rotor outer circumferential portion 161*b*. Therefore, the motor rotor 161 and the rotor magnet 162 rotate with the turbofan 18 as one body around the fan axial center CL.

The motor stator 163 includes a stator coil 163*a* and a stator core 163*b* electrically connected to the electronic substrate 17. The motor stator 163 is disposed on a radially inner side with a small gap left from the rotor magnet 162. The motor stator 163 is fixed to the second cover portion 241 of the second case member 24 with the bearing housing 29 interposed therebetween.

According to the electric motor 16 configured as described above, a change of magnetic flux of the stator core 163*b* is produced by the stator coil 163*a* of the motor stator 163 when the stator coil 163*a* is energized from an external power supply. This change of magnetic flux of the stator core 163*b* generates a force attracting the rotor magnet 162. Accordingly, the motor rotor 161 rotationally moves around the fan axial center CL while receiving the force attracting the rotor magnet 162. In short, the electric motor 16 under energization rotates the turbofan 18 around the fan axial center CL in the state that the motor rotor 161 is fixed to the turbofan 18.

Figure 4:
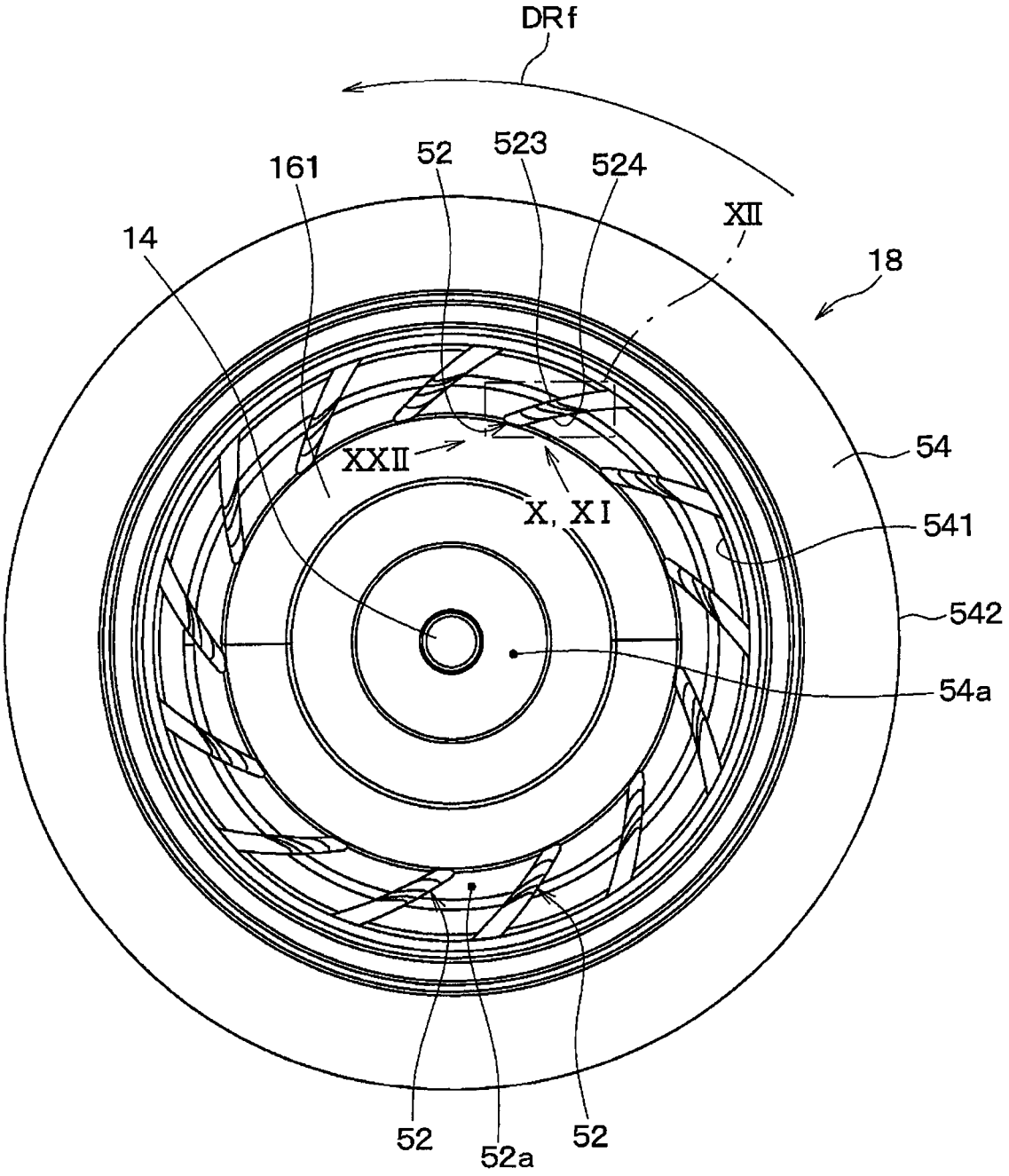
FIG. 4 is a top view of a turbofan and a motor rotor in FIG. 3.
Figure 5:
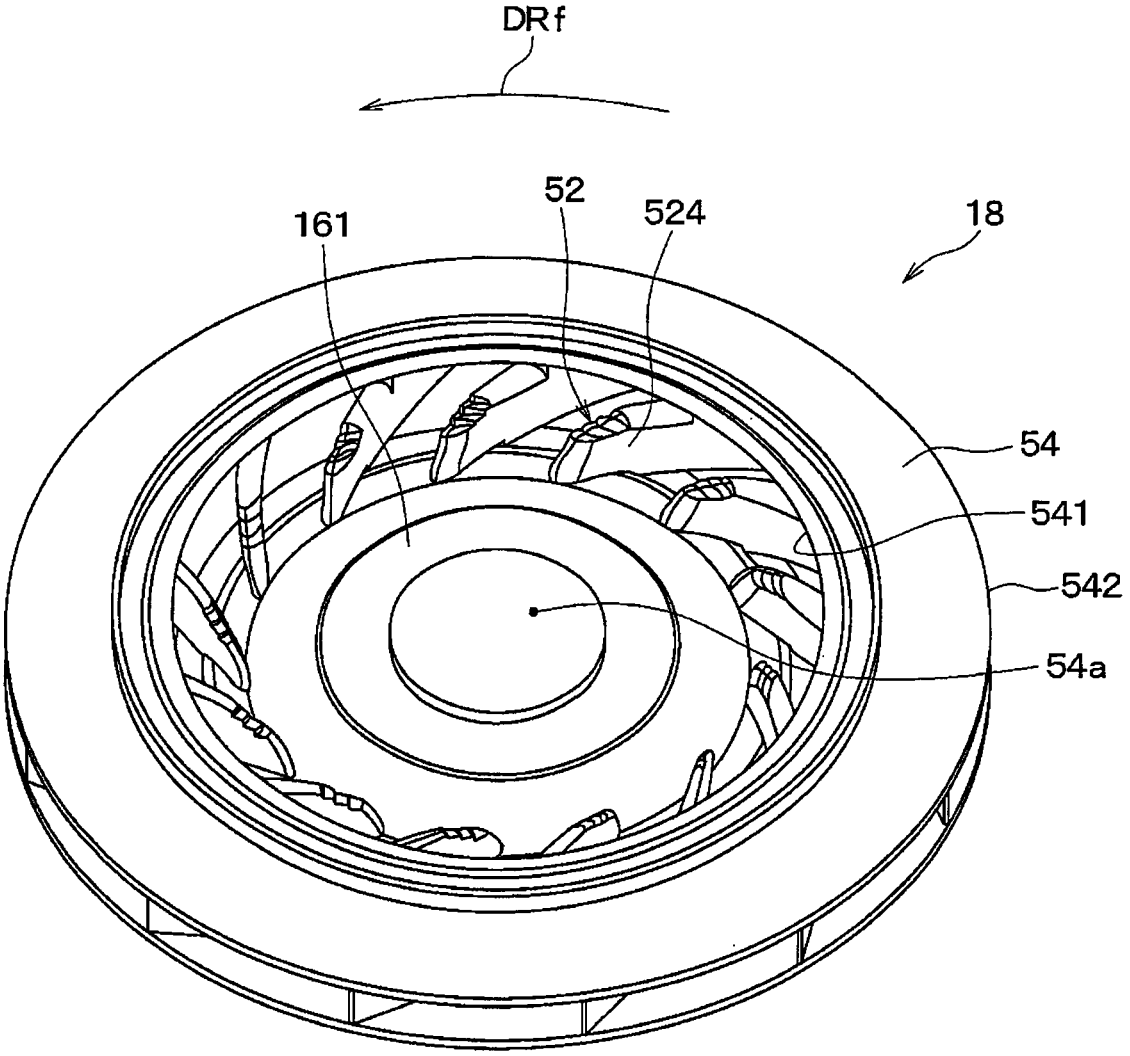
FIG. 5 is a perspective view of the turbofan and the motor rotor in FIG. 3.

As shown in FIGS. 3, 4, and 5, the turbofan 18 is an impeller included in the blower 10. As shown in FIG. 4, the turbofan 18 rotates around the fan axial center CL in a predetermined fan rotation direction DRf to blow air. More specifically, the turbofan 18 rotates around the fan axial center CL to take in air from the first side in the fan axial center direction DRa via the air intake port 221*a* as indicated by an arrow FLa in FIG. 3. Thereafter, the turbofan 18 blows out the taken air toward the outer circumferential side of the turbofan 18 as indicated by an arrow FLb in FIG. 3.

More specifically, the turbofan 18 has a fan body 50 and a side panel 60 as shown in FIG. 3.

The fan body 50 has a plurality of blades 52, a shroud ring 54, and a rotor housing portion 56. The fan body 50 is made of resin. The fan body 50 is molded by one injection molding. More specifically, the plurality of blades 52, the shroud ring 54, and the rotor housing portion 56 constitute an integrally molded product. In this case, the plurality of blades 52, the shroud ring 54, and the rotor housing portion 56 are continuous with each other, and are all made of the same material. Accordingly, the fan body 50 does not have a joining portion for joining the plurality of blades 52 and the shroud ring 54, and also does not have a joining portion for joining the plurality of blades 52 and the rotor housing portion 56.

The plurality of blades 52 are disposed around the rotation shaft 14. In other words, the plurality of blades 52 are disposed around the fan axial center CL. More specifically, the plurality of blades 52 are disposed side by side in the circumferential direction of the fan axial center CL with a clearance left between each of the plurality of blades 52 to allow a flow of air through the clearance.

Each of the blades 52 has first side blade end 521 formed on the first side in the fan axial center direction DRa. Each of the blades 52 has a second side blade end 522 formed on the second side opposite to the first side in the fan axial center direction DRa.

As shown in FIG. 4, each of the blades 52 has a positive pressure surface 523 and a negative pressure surface 524, both constituting a blade shape. The positive pressure surface 523 is a first blade surface located on a leading side in the fan rotation direction DRf. The negative pressure surface 524 is a second blade surface located on a trailing side in the fan rotation direction DRf. In the plurality of blades 52, an inter-blade flow path 52*a* is formed between each adjoining pair of the plurality of blades 52 to allow a flow of air through the inter-blade flow path 52*a*.

As shown in FIGS. 4 and 5, the shroud ring 54 has a shape expanding in a disk shape in the fan radial direction DRr. An intake hole 54*a* formed in the shroud ring 54 on the inner circumferential side is a hole through which air flowing from the air intake port 221*a* of the casing 12 is taken in as indicated by arrows FLa in FIG. 3. Accordingly, the shroud ring 54 has an annular shape.

The shroud ring 54 further includes a ring inner circumferential end 541 and a ring outer circumferential end 542. The ring inner circumferential end 541 is an end of the shroud ring 54 on the inner side in the fan radial direction DRr, and forms the intake hole 54*a*. The ring outer circumferential end 542 is an end of the shroud ring 54 on the outer side in the fan radial direction DRr.

As shown in FIG. 3, the shroud ring 54 is provided on the first side in the fan axial center direction DRa, that is, on the air intake port 221*a* side, with respect to the plurality of blades 52. The shroud ring 54 is connected to the first side blade end 521 of each of the plurality of blades 52.

The rotor housing portion 56 has a cylindrical shape having a center aligned with the fan axial center CL. The rotor housing portion 56 is connected to the second side blade end 522 of each of the plurality of blades 52. In other words, the rotor housing portion 56 is a cylindrical portion extending cylindrically from the second side blade end 522 toward the second side in the fan axial center direction DRa. The rotor housing portion 56 houses the motor rotor 161 on the inner circumferential side of the rotor housing portion 56. The rotor outer circumferential portion 161*b* is press-fitted and fixed to the inner circumferential side of the rotor housing portion 56.

Figure 6:
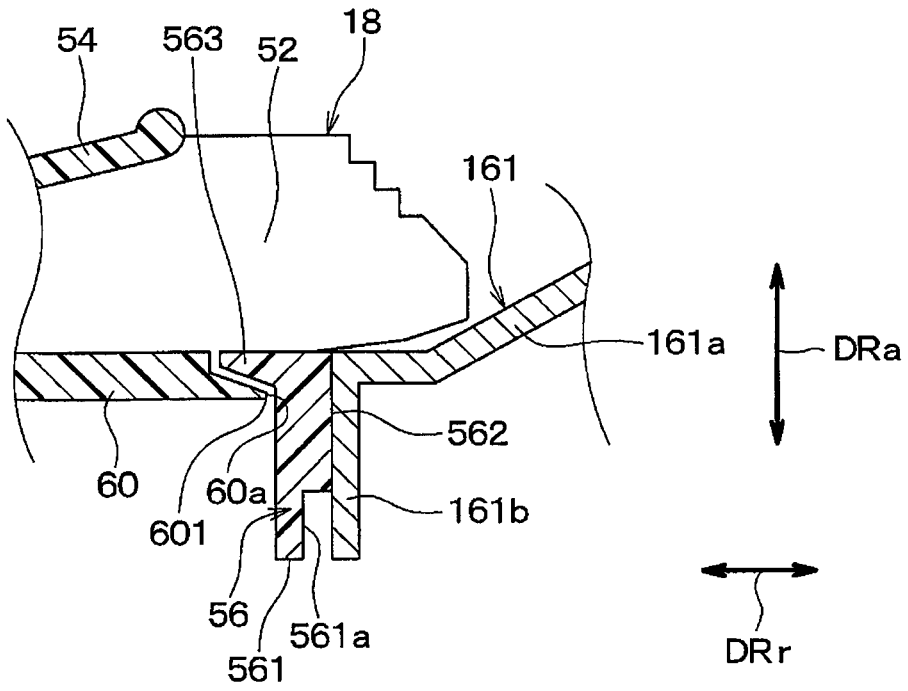
FIG. 6 is an enlarged cross-sectional view of an area around a rotor housing portion of the blower according to at least one embodiment.

More specifically, as shown in FIG. 6, the rotor housing portion 56 has a body portion 561 and a plurality of ribs 562. The body portion 561 is cylindrical and has an inner circumferential surface 561*a*. The plurality of ribs 562 are a plurality of protrusions protruding from the inner circumferential surface 561*a*. Each of the plurality of ribs 562 is arranged in the circumferential direction of the body portion 561 with a clearance left between each other.

Figure 7:
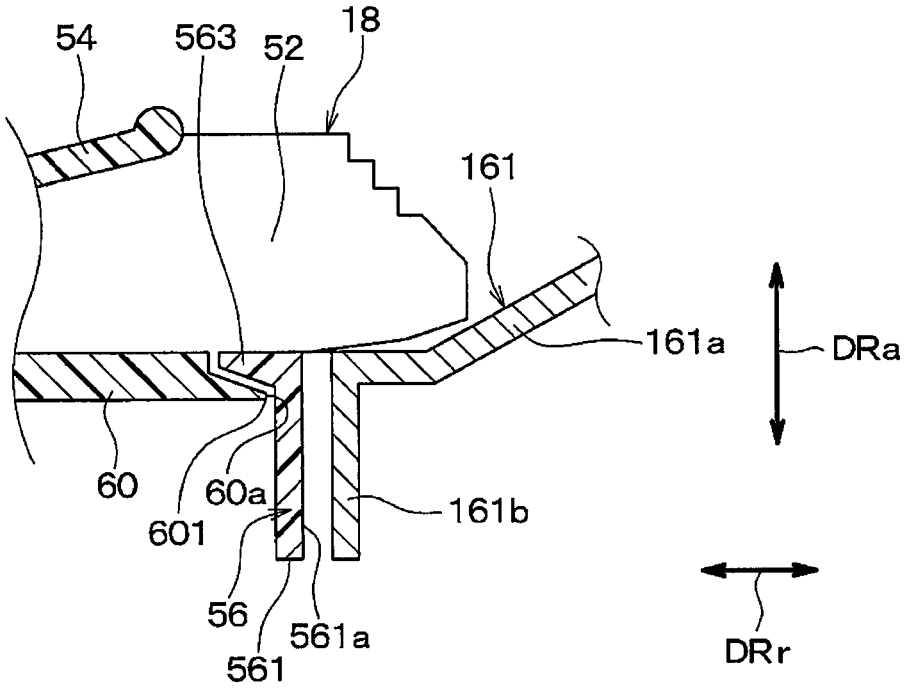

The plurality of ribs 562 extend from an end of the body portion 561 on the first side in the fan axial direction DRa toward the second side in the fan axial direction DRa. The rotor outer circumferential portion 161*b* is press-fitted to the inner side of the plurality of ribs 562. In this manner, the rotor outer circumferential portion 161*b* is fixed to the inner circumferential side of the rotor housing portion 56 in a state that the plurality of ribs 562 are in contact with the rotor outer circumferential portion 161*b*. As shown in FIG. 7, a region included in the inner circumferential surface 561*a* and not having the plurality of ribs 562 is not in contact with the rotor outer circumferential portion 161*b*.

According to the present embodiment, the plurality of blades 52 are continuous with both the shroud ring 54 and the rotor housing portion 56. In other words, the plurality of blades 52 also have a function as a coupling rib for coupling the shroud ring 54 and the rotor housing portion 56 in such a manner as to bridge the shroud ring 54 and the rotor housing portion 56. Accordingly, the plurality of blades 52, the shroud ring 54, and the rotor housing portion 56 are allowed to be formed integrally with each other.

Figure 8:
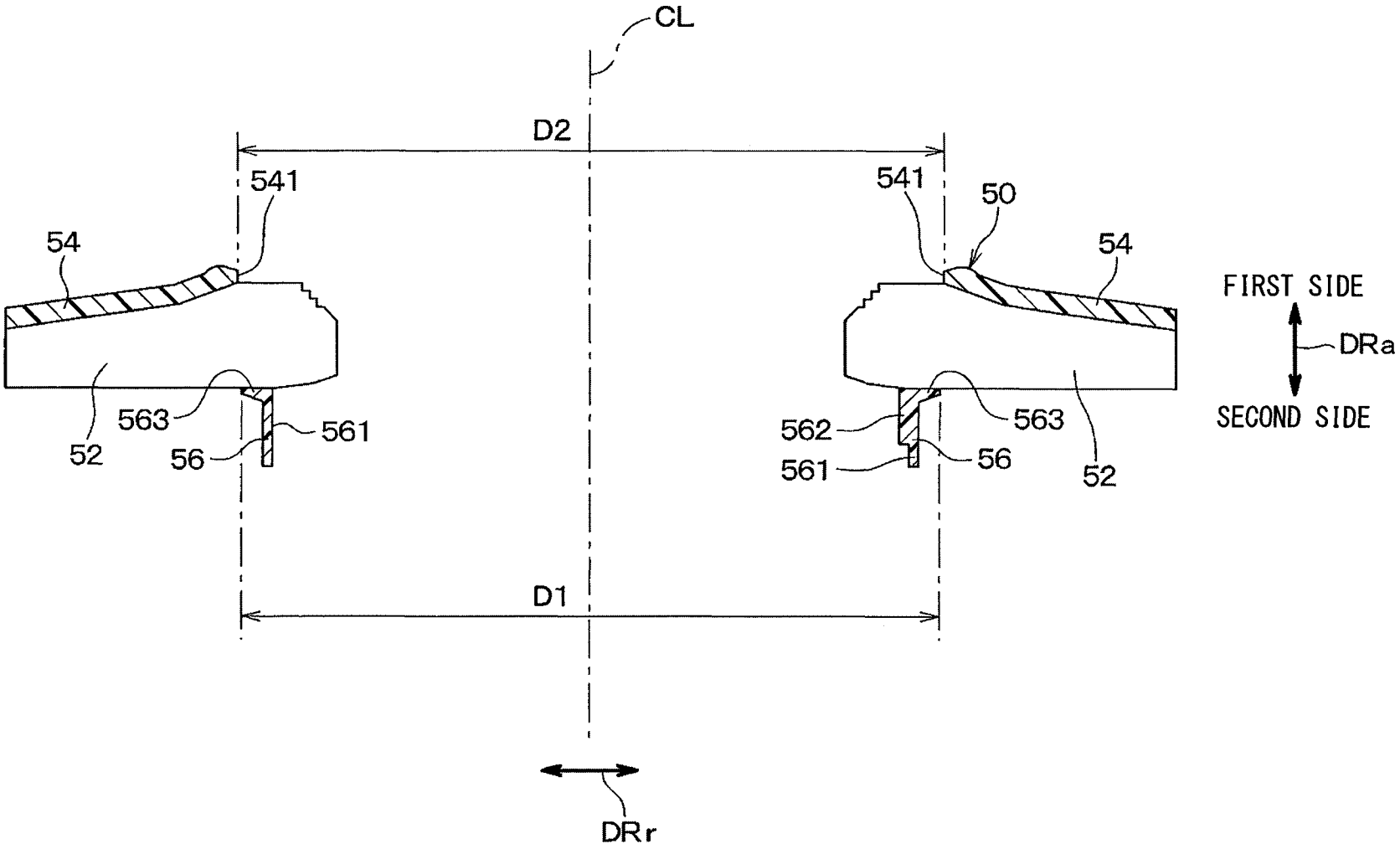
FIG. 8 is a cross-sectional view of a fan body according to at least one embodiment.

Furthermore, as shown in FIG. 8, the whole of the rotor housing portion 56 is disposed on the inner side in the fan radial direction DRr with respect to the ring inner circumferential end 541 of the shroud ring 54. In other words, an outermost diameter D1 of the rotor housing portion 56 is smaller than a minimum inner diameter D2 of the shroud ring 54 (i.e., D1<D2). According to the present embodiment, the outermost diameter D1 of the rotor housing portion 56 corresponds to an outer diameter of a joining portion 563 included in the rotor housing portion 56 and joined to the side panel 60. In this manner, the fan body 50 is allowed to be integrally formed in a state that the fan axial center direction DRa is aligned with a mold-separation direction. The mold-separation direction herein is a mold moving direction relative to a molded product during separation of a molding die from the molded product.

The side panel 60 shown in FIG. 3 has a shape expanding in a disk shape in the fan radial direction DRr. A side panel fitting hole 60*a* formed on the inner circumferential side of the side panel 60 penetrates the side panel 60 in a thickness direction of the side panel 60. Accordingly, the side panel 60 has an annular shape. The side panel 60 is a resin-molded product molded separately from the fan body 50.

The side panel 60 is joined to the second side blade end 522 of each of the plurality of blades 52. In this manner, the side panel 60 is fixed to the second side blade end 522 of each of the plurality of blades 52. According to the present embodiment, the side panel 60 and the motor rotor 161 are connected to the second side blade end of each of the plurality of blades on the second side in the rotation axis direction, and constitute a main panel fixed to the rotation shaft.

For example, joining between the side panel 60 and the blades 52 is achieved by vibration welding or heat welding. Accordingly, in view of weldability by welding between the side panel 60 and the blades 52, each of the side panel 60 and the fan body 50 is preferably made of thermoplastic resin. It is more preferable that the side panel 60 and the fan body 50 be made of material of the same type.

Manufacture of the turbofan 18 as a closed fan is completed by this joining between the side panel 60 and the blades 52. The closed fan herein is a turbofan configured such that both sides of the inter-blade flow paths 52*a* in the fan axial center direction DRa, which paths are formed between the respective adjoining pairs of the plurality of blades 52, are covered by the shroud ring 54 and the side panel 60. More specifically, the shroud ring 54 has a ring guide surface 543 facing the inter-blade flow paths 52*a* and guiding an airflow in the inter-blade flow paths 52*a*. The side panel 60 has a side panel guide surface 603 facing the inter-blade flow paths 52*a* and guiding an airflow in the inter-blade flow paths 52*a*.

The side panel guide surface 603 faces the ring guide surface 543 with the inter-blade flow paths 52*a* interposed between the side panel guide surface 603 and the ring guide surface 543, and is disposed on the outer side in the fan radial direction DRr with respect to the airflow guide surface 164. The side panel guide surface 603 performs a function of smoothly guiding an airflow passing along the airflow guide surface 164 toward a blowout port 18*a*.

The side panel 60 has a side panel inner circumferential end 601 and a side panel outer circumferential end 602. The side panel inner circumferential end 601 is an end of the side panel 60 on the inner side in the fan radial direction DRr, and forms the side panel fitting hole 60*a*. The side panel inner circumferential end 601 is joined to the joining portion 563 of the rotor housing portion 56 as shown in FIGS. 6 and 7. FIGS. 6 and 7 show the side panel inner circumferential end 601 and the joining portion 563 away from each other such that the side panel inner circumferential end 601 and the joining portion 563 are visually recognizable with ease. The side panel outer circumferential end 602 is an end of the side panel 60 on the outer side in the fan radial direction DRr.

As shown in FIG. 3, the side panel outer circumferential end 602 and the ring outer circumferential end 542 are disposed away from each other in the fan axial center direction DRa. The side panel outer circumferential end 602 and the ring outer circumferential end 542 form the blowout port 18*a* between the side panel outer circumferential end 602 and the ring outer circumferential end 542, as a port through which air having passed through the inter-blade flow paths 52*a* is blown out.

Figure 9:
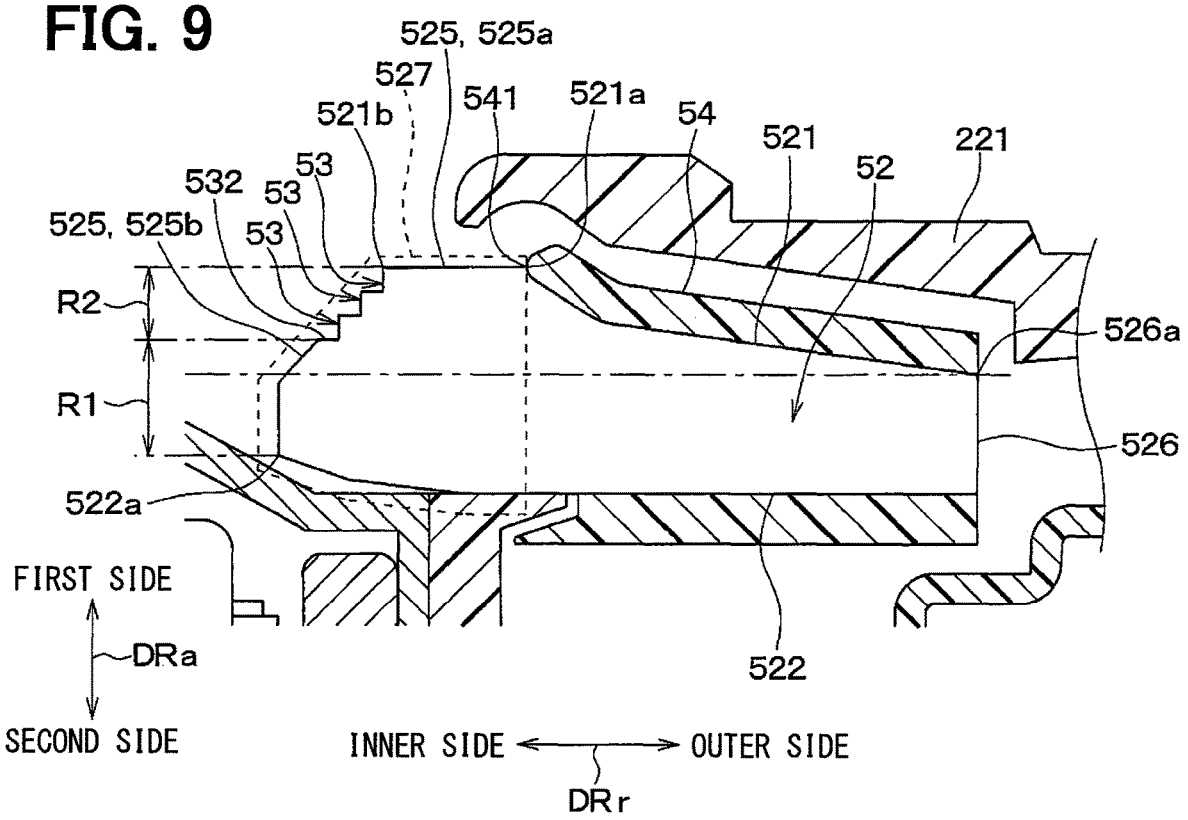
FIG. 9 is an enlarged cross-sectional view of an area around one blade of the blower according to at least one embodiment.

As shown in FIG. 9, each of the plurality of blades 52 has a leading edge 525 and a trailing edge 526.

The leading edge 525 is an edge included in the blade 52 and located on the inner side in the fan radial direction DRr with respect to the shroud ring 54. Accordingly, the leading edge 525 is an upstream edge of the blade 52 in a flow direction of a main flow. The main flow is a flow of air which passes through the intake hole 54*a* and flows toward the inter-blade flow path 52*a* as indicated by arrows FLa and FLb in FIG. 3. In other words, the leading edge 525 is an airflow upstream edge of a projection portion 527 of the blade 52. The projection portion 527 is a portion included in the blade 52 and projecting toward the inner side in the fan radial direction DRr from the ring inner circumferential end 541.

The trailing edge 526 is an edge of the blade 52 on the outer side in the fan radial direction DRr. Accordingly, the trailing edge 526 is a downstream edge of the blade 52 in the flow direction of the main flow.

The leading edge 525 has a radially extending portion 525*a* and an axially extending portion 525*b*.

The radially extending portion 525*a* is a part of the first side blade end 521. More specifically, the radially extending portion 525*a* is a portion included in the first side blade end portion 521 and located on the inner side in the fan radial direction DRr with respect to the ring inner circumferential end 541. The radially extending portion 525*a* extends to an inner end 521*b* of the first side blade end 521 from a connection portion 521*a* of the first side blade end 521 at a connection with the ring inner circumferential end 541. The inner end 521*b* of the first side blade end 521 is an end of the first side blade end 521 on the inner side in the fan axial center direction DRa.

The axially extending portion 525*b* extends from the first side to the second side in the fan axial center direction DRa, covering from the inner end 521*b* of the first side blade end 521 to the inner end 522*a* of the second side blade end 522. The inner end 522*a* of the second side blade end 522 is an end of the second side blade end 522 on the inner side in the fan axial center direction DRa. The axially extending portion 525*b* includes an inclined portion which extends while shifting toward the inner side in the fan radial direction DRr with nearness to the second side from the first side in the fan axial center direction DRa, and further includes a portion extending in parallel to the fan axial center direction DRa.

The axially extending portion 525*b* includes a second side region R1 and a first side region R2. The second side region R1 is a region included in the axially extending portion 525*b* and located on the second side in the fan axial center direction DRa. The first side region R2 is a region included in the axially extending portion 525*b* and located on the first side in the fan axial center direction DRa with respect to the second side region R1. The first side region R2 is a part of the inclined portion. According to the present embodiment, the second side region R1 corresponds to a second side region included in the leading edge and located on the second side in the rotation axis direction. The first side region R2 corresponds to a first side region included in the leading edge and located on the first side in the rotation axis direction with respect to the second side region.

Figure 10:
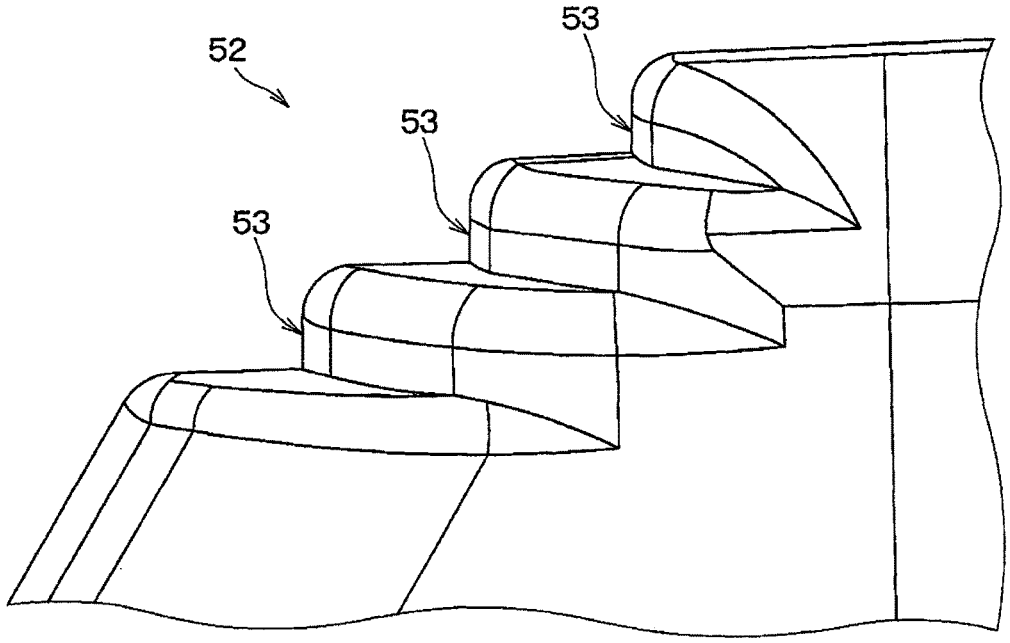
FIG. 10 is a perspective view of the blade viewed in a direction of an arrow X in FIG. 4.

Each of the plurality of blades 52 includes a plurality of stepped portions 53 in the first side region R2. The second side region R1 includes no stepped portion 53. Accordingly, the plurality of stepped portions 53 are formed only in the first side region R2 in the pair of the first side region R2 and the second side region R1. According to the present embodiment, three stepped portions 53 are provided to constitute the plurality of stepped portions 53 as shown in FIG. 10.

Figure 11:
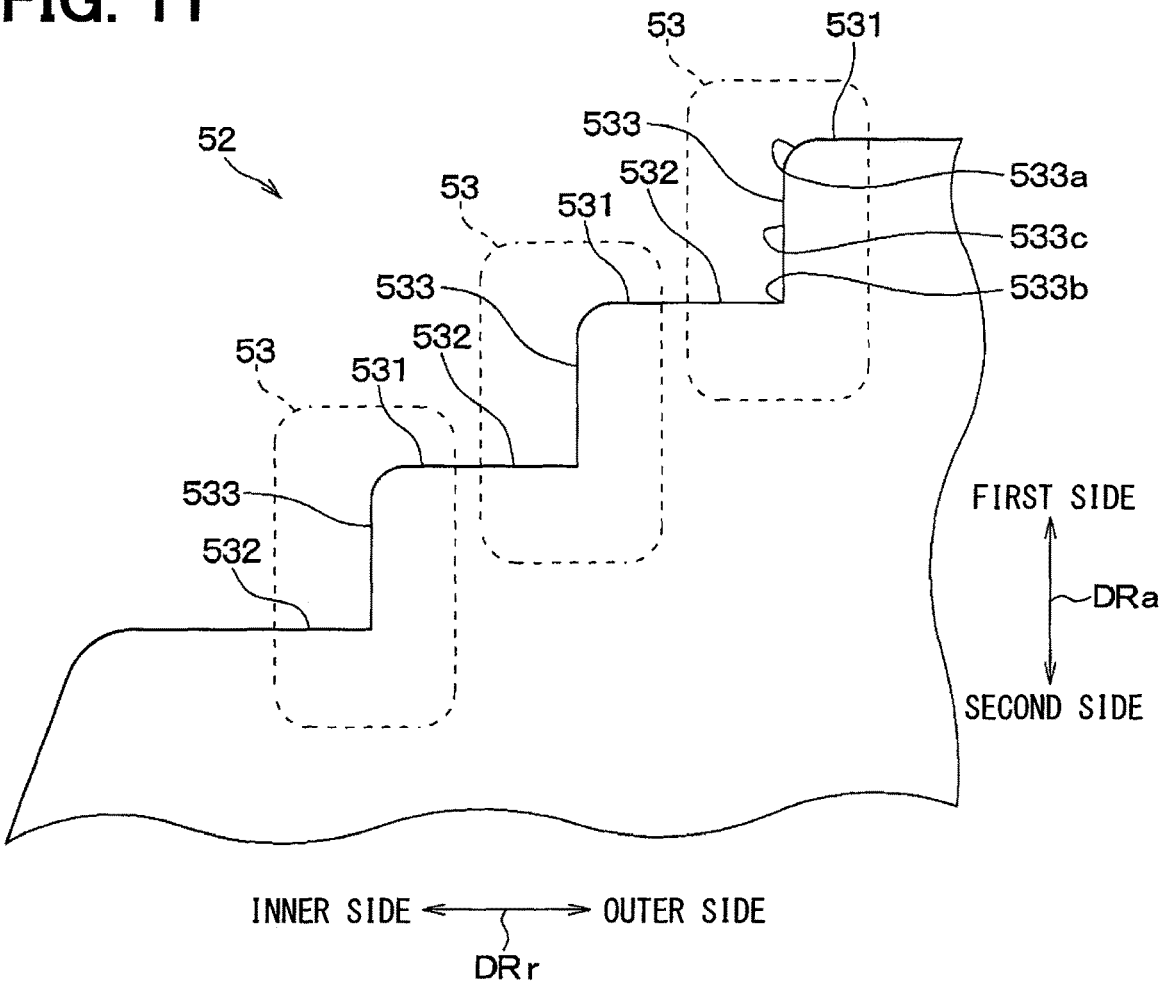
FIG. 11 is a side view of the blade viewed in a direction of an arrow XI in FIG. 4.

As shown in FIG. 11, each of the plurality of stepped portions 53 has a first surface 531, a second surface 532, and a third surface 533.

The first surface 531 extends from the outer side in the fan radial direction DRr toward the inner side in the fan radial direction DRr. The second surface 532 extends from the outer side in the fan radial direction DRr toward the inner side in the fan radial direction DRr. The second surface 532 is located on the second side in the fan axial center direction DRa with respect to the first surface 531. The third surface 533 connects the first surface 531 and the second surface 532 in such a manner as to form a step between the first surface 531 and the second surface 532. Accordingly, each of the stepped portions 53 is a portion which produces two surfaces located at different positions in the fan axial center direction DRa.

Concerning the adjoining stepped portions 53 in the fan axial center direction DRa, the second surface 532 of the stepped portion 53 on the first side in the fan axial center direction DRa and the first surface 531 of the stepped portion 53 on the second side in the fan axial center direction DRa are formed continuously with each other. In other words, the second surface 532 of the stepped portion 53 on the first side in the fan axial center direction DRa and the first surface 531 of the stepped portion 53 on the second side in the fan axial center direction DRa are constituted by a common surface.

According to the present embodiment, a portion included in the first surface 531 and located in a region other than a continuation portion 533*a* at a position continuous with the third surface 533 extends perpendicularly to the fan axial center direction DRr. The second surface 532 also extends perpendicularly to the fan axial center direction DRr. The continuation portion 533*a* between the first surface 531 and the third surface 533 is curved. A continuation portion 533*b* between the second surface 532 and the third surface 533 is not curved but has a corner. The continuation portion 533*b* between the second surface 532 and the third surface 533 may be curved.

A portion 533*c* included in the third surface 533 and located in a region other than the continuation portions 533*a* and 533*b* at positions continuous with the first surface 531 and the second surface 532, respectively, extends in parallel to the fan axial center direction Dra.

As shown in FIG. 9, the first side region R2 is located on the first side in the fan axial center direction DRa with respect to of the trailing edge 526. More specifically, the second surface 532 of the stepped portion 53 included in the plurality of stepped portions 53 and located at a position closest to the second side in the fan axial center direction DRr is located on the first side in the fan axial center direction DRa with respect to an end 526*a* of the trailing edge 526 on the first side in the fan axial center direction DRa.

Figure 12:
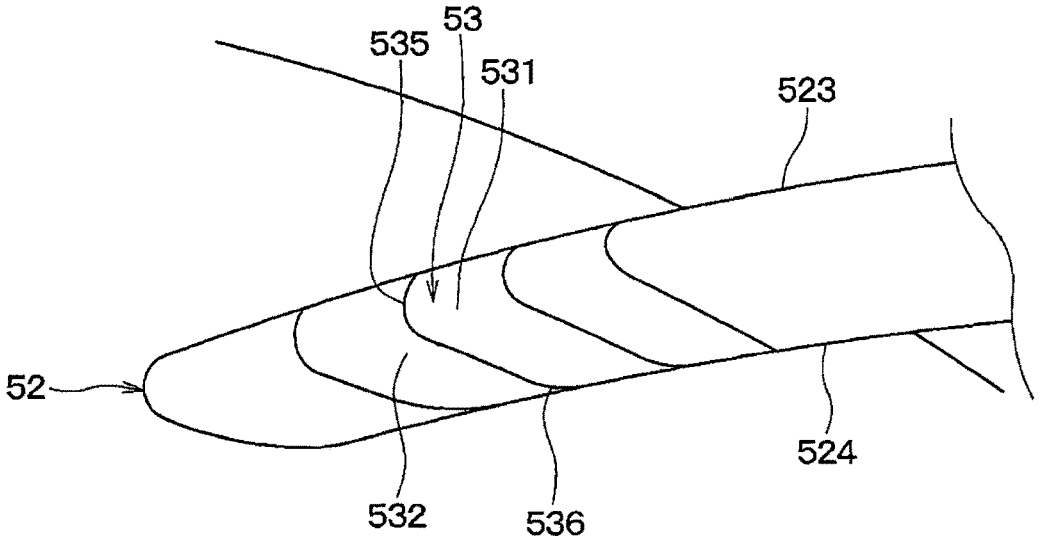
FIG. 12 is an enlarged view of the blade shown in an area XII in FIG. 4.

As shown in FIG. 12, each of the plurality of stepped portions 53 has a positive pressure surface side end 535 and a negative pressure surface side end 536. FIG. 12 is a top view of one of the blades 52 as viewed from the first side in the fan axial center direction DRr. More specifically, FIG. 12 is a view of each of the plurality of stepped portions 53 as viewed from the first side in the fan axial center direction DRr.

The positive pressure surface side end 535 is an end included in the stepped portion 53 and located on the positive pressure surface 523 side and on the inner side in the fan radial direction DRr. The negative pressure surface side end 536 is an end included in the stepped portion 53 and located on the negative pressure surface 524 side and on the inner side in the fan radial direction DRr.

Figure 13:
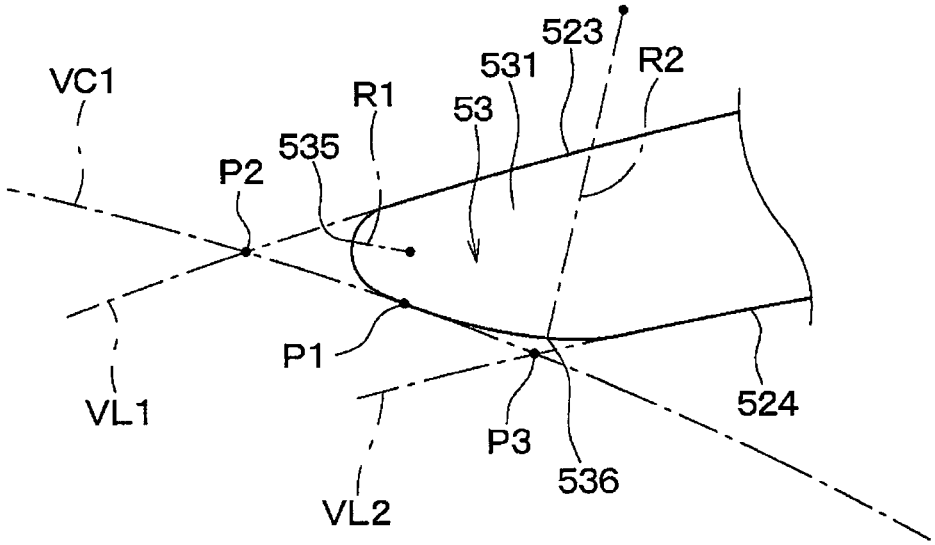
FIG. 13 is a top view of one stepped portion in FIG. 12.

The positive pressure surface side end 535 is curved. Suppose herein that there is defined an imaginary circle VC1 which passes through a point P1 located innermost in the fan radial direction DRr in one of the stepped portions 53, and has a circle center aligned with the fan axial center direction DRa as shown in FIG. 13. The fan axial center direction DRa coincides with a center of the rotation shaft 14. In addition, suppose a positive pressure surface extension line VL1 as an extension from a side included in one of the stepped portions 53 and located on the positive pressure surface 523 side toward the leading end side of the blade 52 along the positive pressure surface 523. The positive pressure surface side end 535 has such a shape that has a rounded vertex coinciding with an intersection point P2 of the imaginary circle VC1 and the positive pressure surface overtime VL1.

Similarly, the negative pressure surface side end 536 is curved. Suppose a negative pressure surface side extension line VL2 as an extension from a side included in one of the stepped portions 53 and located on the negative pressure surface 524 side toward the leading end side of the blade 52 along the negative pressure surface 524 as shown in FIG. 13. The negative pressure surface side end 536 has such a shape that has a rounded vertex coinciding with an intersection point P3 of the imaginary circle VC1 and the negative pressure surface side extension line VL2. The negative pressure surface side end 536 is located on the outer side in the fan radial direction DRr with respect to the imaginary circle VC1.

According to the present embodiment, a part of a side included in the first surface 531 and located between the positive pressure surface side end 535 and the negative pressure surface side end 536 overlaps a part of the imaginary circle VC1 as shown in FIG. 13. In other words, a part of the surface of the stepped portion 53 on the inner side in the fan radial direction DRr has a curved shape extending along the imaginary circle VC1.

As shown in FIG. 13, a radius of curvature R2 of the negative pressure surface side end 536 is larger than a radius of curvature R1 of the positive pressure surface side end 535. Accordingly, a degree of bending of the negative pressure surface side end 536 is smaller than a degree of bending of the positive pressure surface side end 535.

As shown in FIG. 3, the turbofan 18 configured as described above rotationally moves in the fan rotation direction DRf with the motor rotor 161 as one body. The blades 52 of the turbofan 18 therefore give momentum to air in accordance with the movement of the turbofan 18. As a result, the turbofan 18 blows air radially outward from the blowout port 18*a* opened to the outer circumference of the turbofan 18. At this time, air taken from the intake hole 54*a* and delivered by the blades 52, that is, air blown from the blowout port 18*a* is discharged to the outside of the blower 10 via the air blowout port 12*a* constituted by the casing 12.

Figure 14:
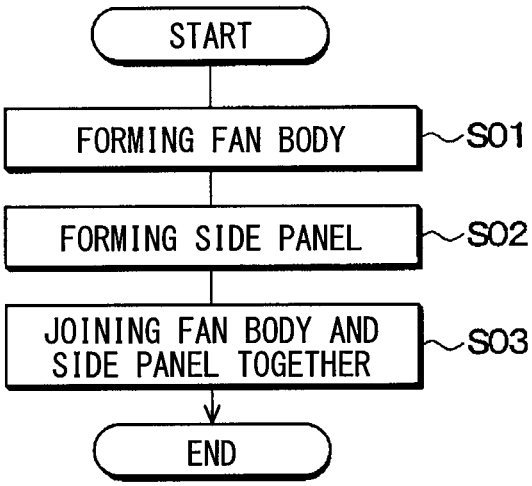
FIG. 14 is a flowchart showing a manufacturing process of the blower according to at least one embodiment.

A method for manufacturing the turbofan 18 will be next described. As shown in FIG. 14, the fan body 50 is initially formed in step S01 as a fan body forming step. In this step, the plurality of blades 52, the shroud ring 54, and the rotor housing portion 56, which are all constituent elements of the fan body 50, are formed integrally with each other.

More specifically, the plurality of blades 52, the shroud ring 54, and the rotor housing portion 56 are integrally molded by injection molding using thermoplastic resin and a pair of molding dies which open and close in the fan axial center direction DRa. The pair of molding dies include a first side die and a second side die. The second side die is a die provided on the second side in the fan axial center direction DRa with respect to the first side die.

In this step, heated and melted thermoplastic resin is injected between the pair of molding dies. After the injected thermoplastic resin solidifies, the pair of molding dies are opened. More specifically, the pair of molding dies are moved from the solidified molded product in the fan axial center direction DRa. As a result, the pair of molding dies are separated from the molded product.

After completion of step S01, the process proceeds to step S02. In step S02 as a side panel forming step, the side panel 60 is formed by injection molding, for example. Note that either step S01 or step S02 may be performed first.

After completion of step S02, the process proceeds to step S03. In step S03 as a joining step, the side panel 60 is joined to each of the second side blade ends 522 of the blades 52. Joining between the blades 52 and the side panel 60 is achieved by vibration welding or heat welding, for example. The turbofan 18 is completed after completion of step S03.

According to the present embodiment described above, each of the plurality of blades 52 has the plurality of stepped portions 53 formed in the leading edge 525.

Figure 15:
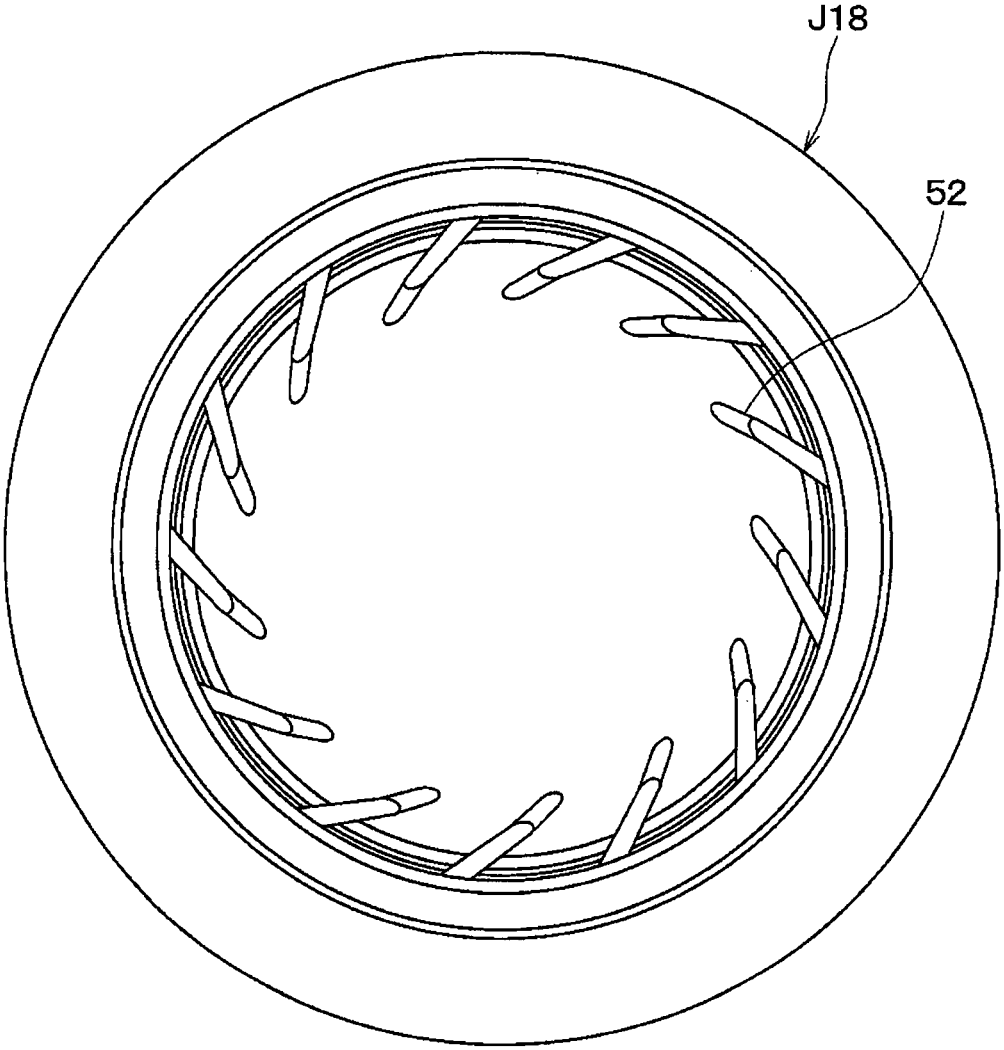
FIG. 15 is a top view of a turbofan according to Comparative Example 1.
Figure 16:
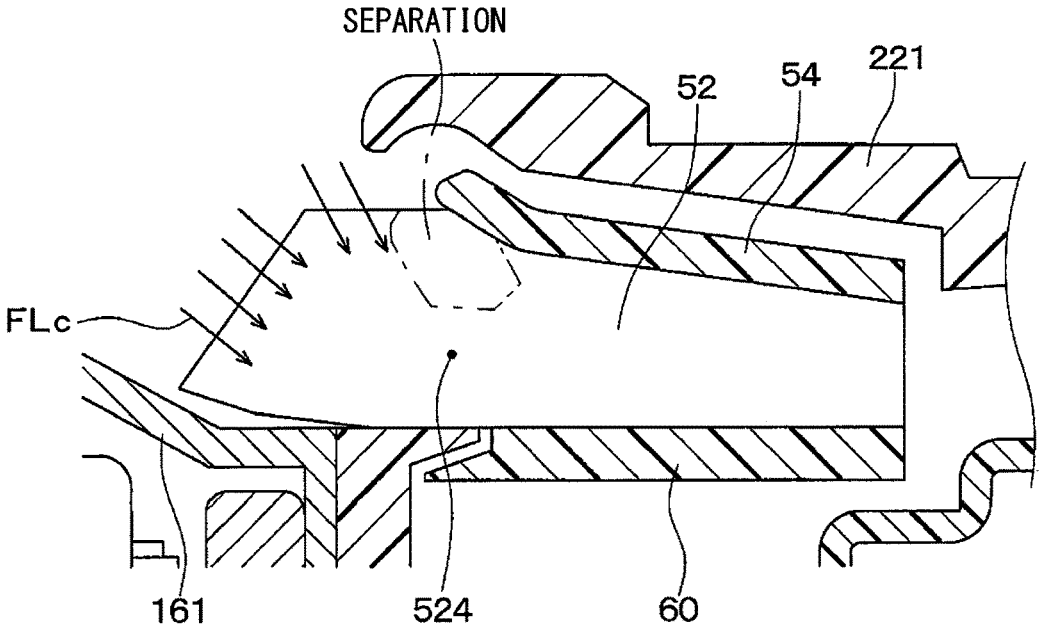
FIG. 16 is a view showing an airflow on a blade on a negative pressure surface side according to Comparative Example 1.

A comparison is herein made between the present embodiment and Comparative Example 1 shown in FIG. 15. Comparative Example 1 is different from the present embodiment in a point that each of a plurality of blades 52 of a turbofan J18 has no stepped portion 53. In Comparative Example 1, the airflow FLc flowing from the leading edge 525 of the blade 52 to the negative pressure surface 524 side of the blade 52 separates from the negative pressure surface 524 on the shroud ring 54 side as shown in FIG. 16. This separation causes noise.

Figure 17:
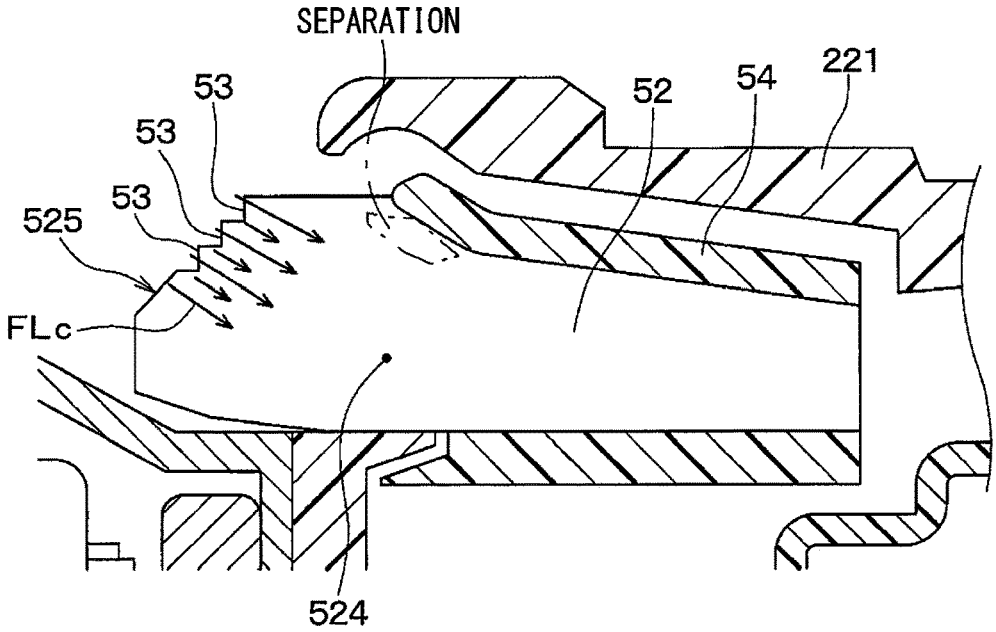
FIG. 17 is a view showing an airflow on the blade on a negative pressure surface side according to at least one embodiment.

According to the present embodiment, however, the plurality of stepped portions 53 are formed in the shroud ring 54 side region of the leading edge 525. Air flows toward the negative pressure surface 524 of the blade 52 along each of the plurality of stepped portions 53. Accordingly, as shown in FIG. 17, separation of the airflow FLc from the negative pressure surface 524 on the shroud ring 54 side can be more reduced than in Comparative Example 1.

This point is more specifically described herein. As shown in FIG. 11, the stepped portion 53 has a protruded portion constituted by the first surface 531 and the third surface 533, and a recessed portion constituted by the second surface 532 and the third surface 533. An airflow passing through the negative pressure surface 524 side from the recessed portion is a flow which intrudes toward the negative pressure surface 524. In this case, the airflow passing through the negative pressure surface 524 side from the protruded portion is pressed against the negative pressure surface 524 by the intruding flow. Accordingly, separation of the airflow FLc from the negative pressure surface 524 can decrease when the airflow FLc passes through the negative pressure surface 524 side.

According to the present embodiment, the negative pressure surface side end 536 of each of the plurality of stepped portions 53 is located on the outer side in the fan radial direction DRr with respect to the imaginary circle VC1 as shown in FIG. 13. In this case, the airflow having passed through each of the plurality of stepped portions 53 can come closer to the negative pressure surface 524 than in a case where the negative pressure surface side end 536 is located on the inner side in the fan radial direction DRr with respect to the imaginary circle VC1. In this configuration, separation of the airflow FLc from the negative pressure surface 524 can also decrease when the airflow FLc passes through the negative pressure surface 524 side.

According to the present embodiment, the bending degree of the negative pressure surface side end 536 of each of the plurality of stepped portions 53 is smaller than the bending degree of the positive pressure surface side end 535 as shown in FIG. 13. In this case, the airflow having passed through each of the plurality of stepped portions 53 can come closer to the negative pressure surface 524. In this configuration, separation of the airflow FLc from the negative pressure surface 524 can also decrease when the airflow FLc passes through the negative pressure surface 524 side.

Figure 18:
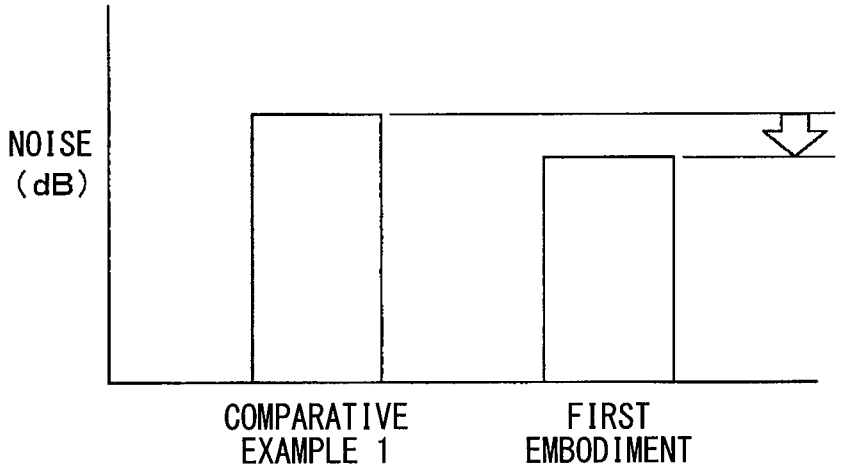
FIG. 18 is a diagram showing results of noise measured under the same measurement conditions for each of the blower of at least one embodiment and the blower of Comparative Example 1.

As obvious from the foregoing results, noise can be more reduced in the present embodiment than in Comparative Example 1. More specifically, as shown in FIG. 18, noise can be reduced by 1 dB. FIG. 18 shows a simulation result obtained by the present inventor.

According to the present embodiment, the plurality of stepped portions are formed not in the entire leading edge 525, but only in a shroud ring side part of the leading edge 525.

The shape of the blade 52 which includes the stepped portions in the leading edge 525 is equivalent to a shape obtained by removing a part from the blade 52 which has no stepped portion in the leading edge 525. Accordingly, each of the blades 52 including the stepped portions in the leading edge 525 has a side surface area reduced by the amount of the area of the stepped portions. In this case, the amount of work performed by each of the blades 52 for air extraction decreases. In other words, the amount of work performed by each of the plurality of blades 52 for air decreases. When the plurality of stepped portions 53 are formed throughout the leading edge 525 unlike the present embodiment, the amount of work performed by the blade 52 significantly decreases.

The second side region R1 is separated from the shroud ring 54. Accordingly, an effect produced by the stepped portions 53 formed in the second side region R1 for reducing separation of the airflow from the negative pressure surface 524 on the shroud ring side becomes smaller than the corresponding effect produced by the stepped portions 53 formed in the first side region R2.

According to the present embodiment, therefore, the plurality of stepped portions 53 are formed only at necessary portions of the leading edge 525. More specifically, the plurality of stepped portions 53 are formed only in first side region R2 in the pair of the first side region R2 and the second side region R1. The first side region R2 of the leading edge 525 is located on the side close to the shroud ring 54. Accordingly, a sufficient effect of reducing separation of the airflow from the shroud ring side can be obtained, wherefore a drop of the amount of work performed by each of the plurality of blades 52 can be reduced.

According to the present embodiment, the plurality of blades 52, the shroud ring 54, and the rotor housing portion 56 constitute an integrally molded product. This integrally molded product includes no structural part on the inner side in the fan radial direction DRr with respect to the rotor housing portion 56 except for the blades 52. The whole of the rotor housing portion 56 is disposed on the inner side in the fan radial direction DRr with respect to the ring inner circumferential end 541 of the shroud ring 54.

According to this configuration, the fan axial direction DRa can be aligned with a mold-separation direction during integral formation of the plurality of blades 52, the shroud ring 54, and the rotor housing portion 56 by using a pair of molding dies. Accordingly, the turbofan 18 having the plurality of blades 52, the shroud ring 54, and the rotor housing portion 56 can be easily formed.

According to the present embodiment, the portion 533*c* included in the third surface 533 and located in a region other than the continuation portions 533*a* and 533*b* at positions continuous with the first surface 531 and the second surface 532, respectively, extends in parallel to the fan axial center direction Dra in each of the plurality of stepped portions 53. Accordingly, the fan axial direction DRa can be aligned with the mold-separation direction during molding of the plurality of blades 52 by using a pair of molding dies.

According to the present embodiment, therefore, the plurality of stepped portions 53 can be formed during integral formation of the turbofan 18 including the plurality of blades 52, the shroud ring 54, and the rotor housing portion 56.

Second Embodiment

Figure 19:
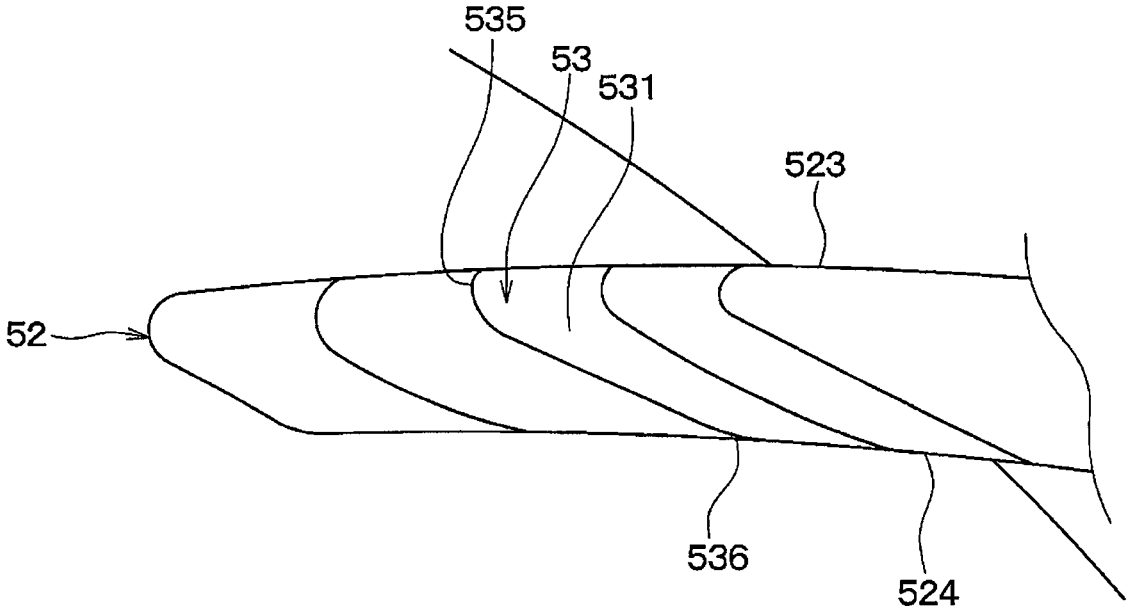
FIG. 19 is a top view of a part of a blade according to at least one embodiment.
Figure 20:
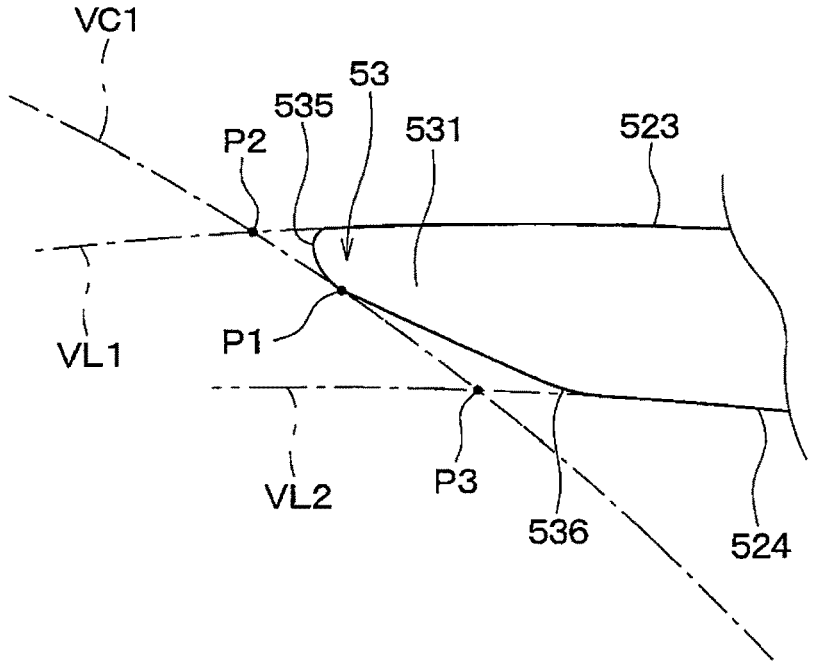
FIG. 20 is a top view of one stepped portion in FIG. 19.

As shown in FIGS. 19 and 20, the present embodiment is different from the first embodiment in the shape of each of the stepped portions 53 when viewed from the first side in the fan axial center direction DRa. The other structures of the blower 10 are similar to the corresponding structures of the first embodiment.

As shown in FIG. 19, each of the plurality of stepped portions 53 has a more tapered shape than the corresponding shape in the first embodiment.

As shown in FIG. 20, the negative pressure surface side end 536 is located on the outer side in the fan radial direction DRr with respect to the imaginary circle VC1. According to the present embodiment, the negative pressure surface side end 536 is separated farther from P3 toward the outer side in the fan radial direction DRr than in the first embodiment. In the present embodiment, therefore, the airflow having passed through each of the plurality of stepped portions 53 can come closer to the negative pressure surface 524.

According to the present embodiment, a part of the surface of each of the stepped portions 53 on the inner side in the fan radial direction DRr is a flat surface. More specifically, as shown in FIG. 20, each of the stepped portions 53 has a flat surface linearly extending toward the negative pressure surface 524 from the point P1 of the stepped portion 53 at a position closest to the inner side in the fan radial direction DRr.

Third Embodiment

Figure 21:
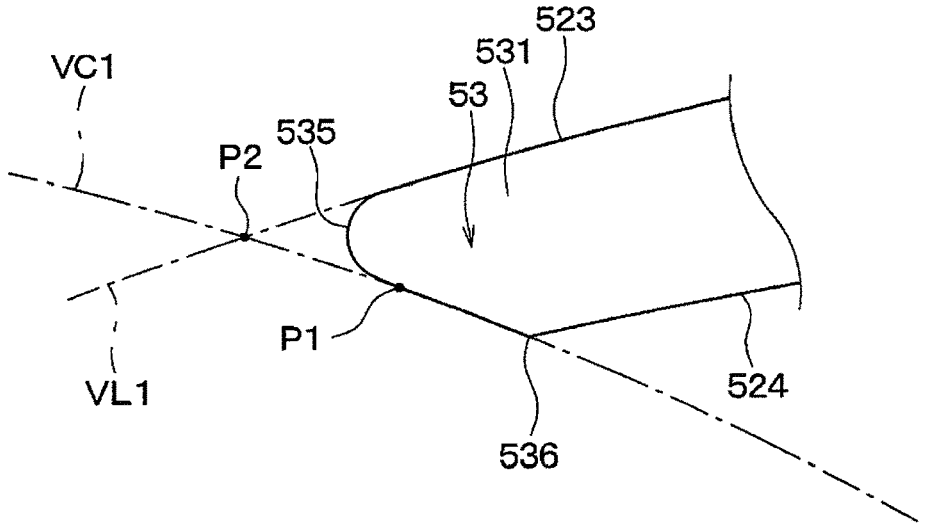
FIG. 21 is a top view of one stepped portion according to at least one embodiment.

According to the first and second embodiments, the negative pressure surface side end 536 is located on the outer side in the fan radial direction DRr with respect to the imaginary circle VC1. According to the present embodiment, however, the negative pressure surface side end 536 is located on the imaginary circle VC1 as shown in FIG. 21. The negative pressure surface side end 536 is a corner having a vertex coinciding with the intersection of the imaginary circle VC1 and the negative pressure surface 524. In this case, the airflow having passed through each of the plurality of stepped portions 53 can similarly come closer to the negative pressure surface 524 than in the case where the negative pressure surface side end 536 is located on the inner side in the fan radial direction DRr with respect to the imaginary circle VC1.

Fourth Embodiment

Figure 22:
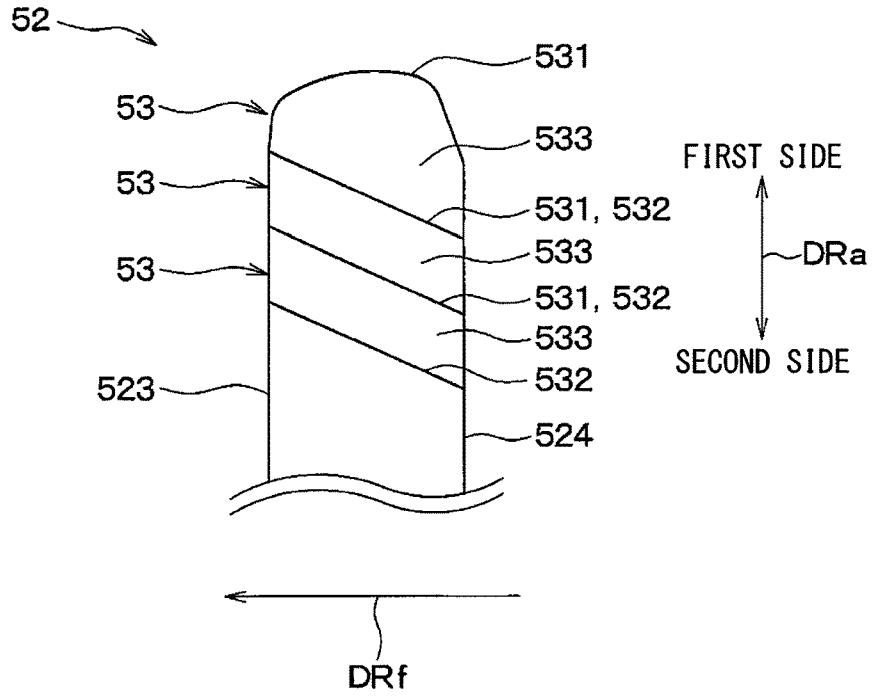
FIG. 22 is a front view of a leading end of a blade according to at least one embodiment as viewed in a direction of an arrow XXII in FIG. 4.

As shown in FIG. 22, the present embodiment is different from the first embodiment in a point that each of the plurality of stepped portions 53 is inclined. The other configurations of the blower 10 are similar to the corresponding configurations of the first embodiment.

According to the first embodiment, the second surface 532 of each of the stepped portions 53 is a surface perpendicular to the fan axial center direction DRa. Accordingly, the second surface 532 is configured such that the positive pressure surface 523 side region and the negative pressure surface 524 side region of the second surface 532 are located at the same position in the fan axial center direction DRr.

According to the present embodiment, however, the second surface 532 is inclined to a surface perpendicular to the fan axial center direction DRa such that the second surface 532 shifts toward the second side in the fan axial center direction DRa with nearness to the negative pressure surface 524 from the positive pressure surface 523. In other words, the second surface 532 extends while shifting toward the second side in the fan axial center direction DRa with nearness to the negative pressure surface 524 from the positive pressure surface 523. The second surface 532 is a flat surface or a substantially flat surface.

According to this configuration, the airflow having passed through each of the plurality of stepped portions 53 can come closer to the negative pressure surface 524 than in a case where the second surface 532 of each of the plurality of stepped portions 53 is a surface perpendicular to the fan axial center direction DRa. Accordingly, separation of the airflow FLc from the negative pressure surface 524 can further decrease when the airflow FLc passes through the negative pressure surface 524 side.

Figure 23:
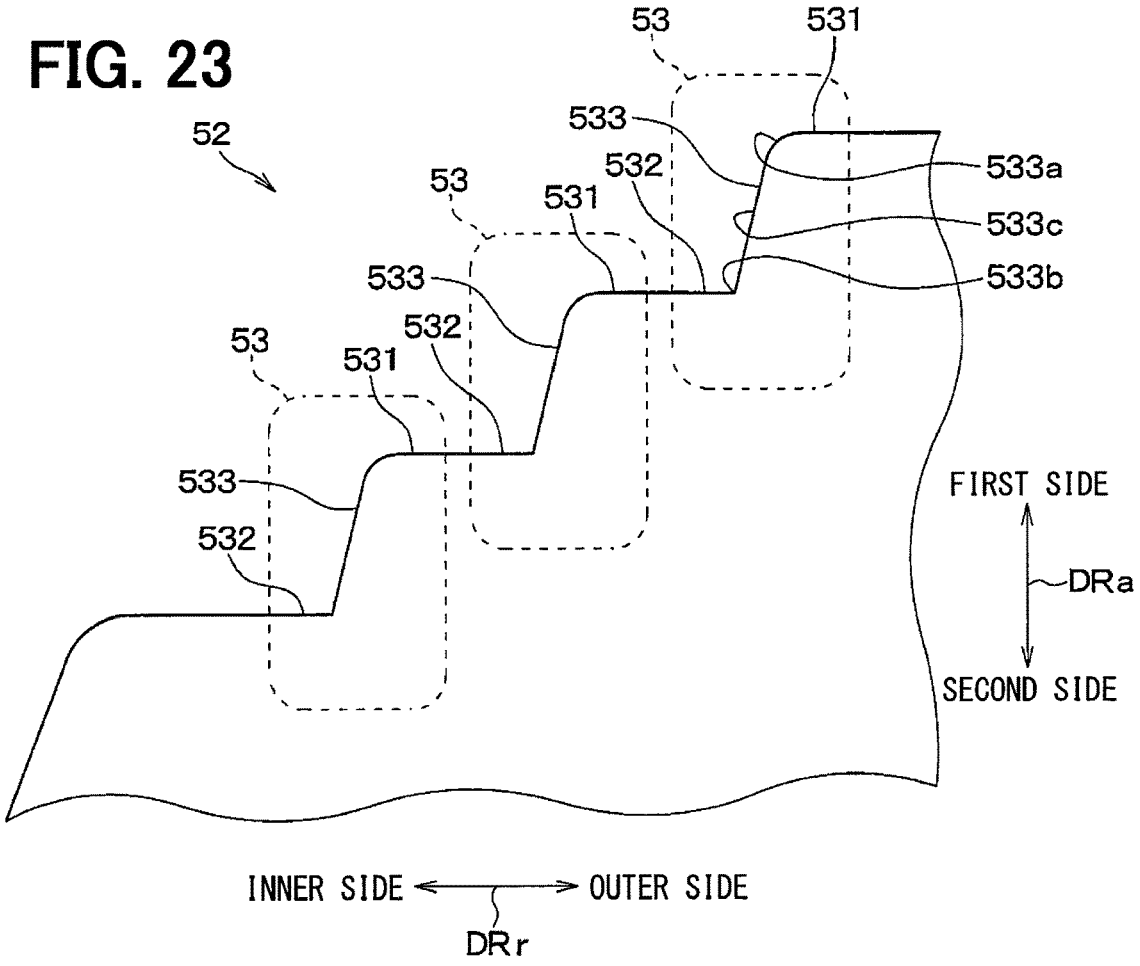
FIG. 23 is a side view of a part of a blade of a different embodiment.

Other Embodiments (1) According to the respective embodiments described above, the portion 533*c* included in the third surface 533 and located in a region other than the continuation portions 533*a* and 533*b* at positions continuous with the first surface 531 and the second surface 532, respectively, extends in parallel to the fan axial center direction Dra as shown in FIG. 11. However, as shown in FIG. 23, the portion 533*c* included in the third surface 533 and located in the region other than the continuation portions 533*a* and 533*b* may be inclined to the fan axial center direction Dra in such a direction as to shift toward the inner side in the fan radial direction DRr with nearness to the second side from the first side in the fan axial center direction DRa. In this configuration, the fan axial direction DRa can also be aligned with the mold-separation direction during formation of the plurality of blades 52 by using a pair of molding dies.

Figure 24:
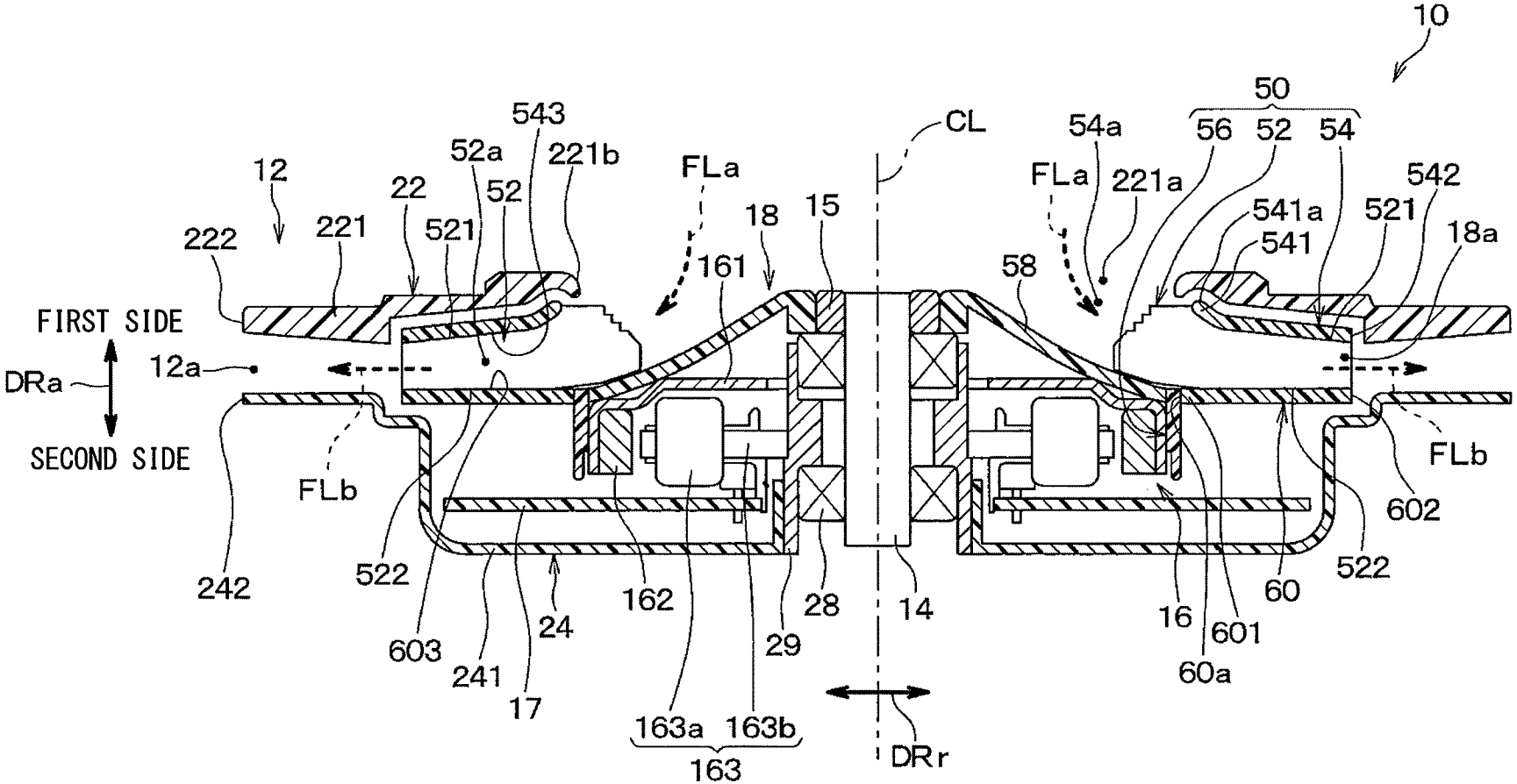
FIG. 24 is a cross-sectional view of a blower according to a different embodiment.

(2) According to the respective embodiments described above, the motor rotor 161 is used as a fixing member for fixing the rotation shaft 14 and the turbofan 18. However, a fan boss portion 58 may be provided to function as this fixing member as shown in FIG. 24. In this case, the side panel 60 and the fan boss portion 58 are connected to the second side blade end of each of the plurality of blades on the second side in the rotation axis direction to constitute a main panel fixed to the rotation shaft.

The blower 10 shown in FIG. 24 is different from the blower 10 of the first embodiment in a point that the fan boss portion 58 is provided. The other configurations of the blower 10 are similar to the corresponding configurations of the first embodiment. The fan boss portion 58 is a resin-molded product molded separately from the fan body 50. The fan boss portion 58 is joined to the second side blade end 522 and the rotor housing portion 56. According to the present embodiment, a surface of the fan boss portion 58 on the first side in the fan axial center direction DRa constitutes an airflow guide surface for guiding an airflow, instead of the surface 164 of the rotor body portion 161*a* of the first embodiment.

(3) According to the respective embodiments described above, the leading edge 525 of the blade 52 includes the radially extending portion 525*a* and the axially extending portion 525*b*. However, the radially extending portion 525*a* may be eliminated from the leading edge 525. In this case, the plurality of stepped portions 53 may be formed toward the second side in the fan axial center direction DRa from the connection portion 521*a* of the first side blade end 521 at the position of connection with the ring inner circumferential end 541.

(4) According to the respective embodiments described above, the boundary between the first side region R2 and the second side region R1 is included in the trailing edge 526 and located in a region on the first side in the fan axial center direction DRa with respect to the end 526*a* on the first side in the fan axial center direction DRa as shown in FIG. 9. The boundary between the first side region R2 and the second side region R1 may be located at the same position as the end portion 526*a* of the trailing edge 526 on the first side in the fan axial center direction DRa.

(5) According to the respective embodiments described above, the plurality of stepped portions 53 are formed only in the first side region R2 in the pair of the first side region R2 and the second side region R1. However, the plurality of stepped portions 53 are only required to be formed in a part of the leading edge 525, and formed in at least the first side region R2 in the pair of the first side region R2 and the second side region R1. The configuration meeting only this requirement also produces effects similar to the effects of the first embodiment. However, it is preferable that the plurality of stepped portions 53 be formed only in first side region R2 in the pair of the first side region R2 and the second side region R1. This configuration is preferable in view of producing a sufficient effect which reduces separation of the airflow from the shroud ring side while enhancing the effect of reducing a drop of the amount of work performed by each of the plurality of blades 52.

(6) According to the respective embodiments described above, the number of stepped portions 53 provided for each of the plurality of blades 52 is three. However, this number may be two or four or more. Alternatively, only the one stepped portion 53 may be formed in each of the plurality of blades 52. These configurations provide effects similar to the effects of the first embodiment.

(7) According to the respective embodiments described above, the plurality of blades 52, the shroud ring 54, and the rotor housing portion 56 are constituted by an integrally molded product. However, other configurations may be adopted The plurality of blades 52 may be provided separately from either one or both of the shroud ring 54 and the rotor housing portion 56. Even in these configurations, it is preferable that the shapes of the plurality of stepped portions 53 be similar to the corresponding shapes of the first embodiment. In this case, the fan axial direction DRa can be aligned with the mold-separation direction during resin-molding of the plurality of blades 52. In case of the plurality of blades 52 provided separately from other members, the main panel may be constituted by only one component.

(8) The present disclosure is not limited to the embodiment described above, but may be appropriately modified within the scope of the appended claims, and includes various modifications and variations within an equivalent range. The respective embodiments described herein are not embodiments unrelated to each other, and therefore can be appropriately combined unless such combinations are obviously inappropriate. According to the respective embodiments described above, needless to say, elements constituting the respective embodiments are not necessarily essential unless clearly expressed as particularly essential, or considered as obviously essential in principle, for example. According to the respective embodiments described above, values such as numbers of the constituent elements, numerical values, quantities, and ranges in the embodiments are not limited to specific values unless clearly expressed as particularly essential, or considered as obviously limited to the specific values in principle, for example. According to the respective embodiments described above, materials, shapes, positional relationships, or others of the constituent elements and the like described in the embodiments are not limited to specific materials, shapes, positional relationships, or others unless clearly expressed, or limited to the specific materials, shapes, positional relationships, or others in principle.

CONCLUSION

According to a first aspect presented in part or all of the respective embodiments described above, a centrifugal blower includes a rotation shaft and a turbofan. The turbofan has a plurality of blades, a shroud ring, and a main panel. Each of the plurality of blades has a leading edge and a trailing edge. The leading edge includes a second side region, and a first side region located on a first side in a rotation axis direction with respect to the second side region. The first side region is located on the first side in the rotation axis direction with respect to the trailing edge. One or a plurality of stepped portions are formed only in a part of the leading edge and in at least the first side region in the pair of the first side region and the second side region.

According to a second aspect, each of the one or plurality of stepped portions includes a first surface, a second surface, and a third surface. The first surface extends from an outer side in a radial direction toward an inner side in the radial direction. The second surface extends from the outer side in the radial direction toward the inner side in the radial direction, and is located on the second side in the rotation axis direction with respect to the first surface. The third surface connects the first surface and the second surface in such a manner as to form a step between the first surface and the second surface. A portion included in the third surface and located in a region other than an end continuous with the first surface and the second surface extends in parallel to the rotation axis direction, or extends while shifting toward the inner side in the radial direction with nearness to the second side from the first side in the rotation axis direction.

Accordingly, the rotation axis direction can be aligned with a mold-separation direction during molding of the plurality of blades by using a pair of molding dies. Accordingly, the plurality of blades each having the one or plurality of stepped portions can be easily formed.

According to a third aspect, each of the plurality of blades includes a positive pressure surface and a negative pressure surface. The second surface of the stepped portion extends while shifting toward the second side in the rotation axis direction with nearness to the negative pressure surface from the positive pressure surface.

According to this aspect, an airflow having passed through the one or plurality of stepped portions can come closer to the negative pressure surface in comparison with a configuration which includes the second surface perpendicular to the rotation axis direction.

According to a fourth aspect, the one or plurality of stepped portions are formed only in the first side region in the pair of the first side region and the second side region. This configuration produces a sufficient effect which reduces separation of an airflow from the shroud ring side while enhancing the effect of reducing a drop of the amount of work performed by the blades.

According to a fifth aspect, each of the plurality of blades includes a positive pressure surface and a negative pressure surface. Each of the one or plurality of stepped portions has a negative pressure surface side end located near the negative pressure surface and on the inner side in the radial direction. The negative pressure surface side end is located on an imaginary circle or on the outer side in the radial direction with respect to the imaginary circle, the imaginary circle passing through a point of the stepped portion at an innermost position in the radial direction, and having a circle center aligned with a center of the rotation shaft.

According to this aspect, the airflow having passed through the one or plurality of stepped portions can come closer to the negative pressure surface than in a case where the negative pressure surface side end is located on the inner side in the radial direction with respect to the imaginary circle.

According to a sixth aspect, each of the one or plurality of stepped portions has a positive pressure surface side end located near the positive pressure surface and on the inner side in the radial direction. Each of the positive pressure surface side end and the negative pressure surface side end is curved. A degree of bending of the negative pressure surface side end is smaller than a degree of bending of the positive pressure surface side end.

According to this aspect, the airflow having passed through the one or plurality of stepped portions can come closer to the negative pressure surface.

What is claimed is:

1. A centrifugal blower that blows air, the centrifugal blower comprising:

a rotation shaft; and a turbofan fixed to the rotation shaft and configured to rotate with the rotation shaft, wherein the turbofan includes a plurality of blades disposed around the rotation shaft, a shroud ring having an annular shape to define an intake hole through which the air is taken in, the shroud ring being connected to a first side blade end of each blade of the plurality of blades on a first side in a rotation axis direction, and a main panel connected to a second side blade end of each blade on a second side in the rotation axis direction, the main panel being fixed to the rotation shaft, each blade includes a leading edge that is an edge located inward of the shroud ring in a radial direction of the turbofan, and a trailing edge that is an edge located on an outer side in the radial direction of the turbofan, the leading edge includes a second side region located on the second side in the rotation axis direction, and a first side region located on the first side in the rotation axis direction of the second side region, the first side region is located on the first side in the rotation axis direction compared with an intersection of the trailing edge and the shroud ring, a plurality of stepped portions are formed only in a part of the leading edge, the plurality of stepped portions being formed only in the first side region, each blade includes a positive pressure surface located on a leading side in a rotation direction of the turbofan, and a negative pressure surface located on a trailing side in the rotation direction, each stepped portion of the plurality of stepped portions has a negative pressure surface side end located adjacent to the negative pressure surface and on the inner side in the radial direction, an imaginary circle whose center is a center of the rotation shaft passes through a point of each stepped portion, the point being located innermost in each stepped portion in the radial direction, the negative pressure surface side end is located on the imaginary circle or located outside the imaginary circle in the radial direction, each stepped portion has a positive pressure surface side end located adjacent to the positive pressure surface and on the inner side in the radial direction, each of the positive pressure surface side end and the negative pressure surface side end is curved, and a radius of curvature of the negative pressure surface side end is larger than a radius of curvature of the positive pressure surface side end.

* * * * *